US011285724B2

(12) United States Patent
Nakamura et al.

(10) Patent No.: US 11,285,724 B2
(45) Date of Patent: Mar. 29, 2022

(54) WASTE LIQUID COLLECTING DEVICE, LIQUID EJECTING APPARATUS, AND MAINTENANCE METHOD OF LIQUID EJECTING APPARATUS

(71) Applicant: SEIKO EPSON CORPORATION, Tokyo (JP)

(72) Inventors: Chikashi Nakamura, Azumino (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 22 days.

(21) Appl. No.: 16/906,612

(22) Filed: Jun. 19, 2020

(65) Prior Publication Data

US 2020/0398572 A1 Dec. 24, 2020

(30) Foreign Application Priority Data

Jun. 21, 2019 (JP) ..... JP2019-115588

(51) Int. Cl.
*B41J 2/165* (2006.01)

(52) U.S. Cl.
CPC ..... *B41J 2/16523* (2013.01); *B41J 2/16535* (2013.01); *B41J 2/16552* (2013.01)

(58) Field of Classification Search
CPC . B41J 2/16523; B41J 2/16535; B41J 2/16552
See application file for complete search history.

(56) References Cited

U.S. PATENT DOCUMENTS 4,878,069 A * 10/1989 Kiyohara ..... B41J 2/175 347/86
7,857,418 B2 * 12/2010 Matsuhashi ..... B41J 2/16585 347/32
2004/0085429 A1 * 5/2004 Morikoshi ..... B41J 11/0065 347/106
2005/0001874 A1 * 1/2005 Gotoh ..... B41J 2/16523 347/36
2007/0257962 A1 * 11/2007 Ogawa ..... D05C 7/02 347/33
2009/0046122 A1 * 2/2009 Inoue ..... B41J 2/16538 347/33
2013/0241995 A1 9/2013 Maruyama
2018/0162120 A1 6/2018 Matsuoka
(Continued)

FOREIGN PATENT DOCUMENTS

GB 2238510 A * 6/1991 ..... B41J 2/16535
JP 2002-052743 2/2002
JP 2002-086762 3/2002
(Continued)

*Primary Examiner* — Sharon Polk
(74) *Attorney, Agent, or Firm* — Workman Nydegger

(57) ABSTRACT

A waste liquid collecting device is a device which is located to face a nozzle surface in which nozzles of a liquid ejecting portion are disposed, which includes a waste liquid receiving member to receive a liquid to be discharged from the nozzles, and which collects the liquid, and the waste liquid receiving member has dripping waste liquid receiving areas which are provided with through-holes and which receive the liquid to drip down after being discharged from the nozzles and staying on the nozzle surface and flushing receiving areas which are not provided with the through-holes and which receive the liquid to be ejected from the nozzles.

10 Claims, 12 Drawing Sheets

(56) References Cited

U.S. PATENT DOCUMENTS

2019/0105905 A1 4/2019 Matsuoka et al.

FOREIGN PATENT DOCUMENTS

| | | |
|---|---|---|
| JP | 2004-074640 | 3/2004 |
| JP | 2008-229919 | 10/2008 |
| JP | 2013-188964 | 9/2013 |
| JP | 2014-195972 | 10/2014 |
| JP | 2018-094743 | 6/2018 |
| JP | 2018-122533 | 8/2018 |
| JP | 2019-064234 | 4/2019 |

* cited by examiner

WASTE LIQUID COLLECTING DEVICE, LIQUID EJECTING APPARATUS, AND MAINTENANCE METHOD OF LIQUID EJECTING APPARATUS

The present application is based on, and claims priority from JP Application Serial Number 2019-115588, filed Jun. 21, 2019, the disclosure of which is hereby incorporated by reference herein in its entirety.

BACKGROUND

1. Technical Field

The present disclosure relates to a waste liquid collecting device, a liquid ejecting apparatus including a waste liquid collecting device, and a maintenance method of a liquid ejecting apparatus.

2. Related Art

For example, JP-A-2013-188964 has disclosed a printer which is one example of a liquid ejecting apparatus to perform printing by ejecting an ink as one example of a liquid from a recording head as one example a liquid ejecting portion. The printer includes a flushing box as one example of a waste liquid collecting device which receives an ink jetted from nozzles by a flushing operation. The flushing box includes a case and an ink absorber as one example of a waste liquid receiving member fitted to an opening of the case. After being absorbed in the ink absorber, the ink drips down into the case.

As a maintenance of the liquid ejecting portion, a discharge maintenance discharging a pressurized liquid from nozzles as a waste liquid has been performed. The amount of the waste liquid to be discharged by the discharge maintenance is larger than the amount of a waste liquid to be discharged by a flushing. Hence, when the waste liquid discharged by the discharge maintenance is received by the waste liquid receiving member, the waste liquid receiving member and the liquid ejecting portion are coupled to each other with the waste liquid interposed therebetween, and as a result, the maintenance of the liquid ejecting portion may not be preferably performed in some cases.

SUMMARY

According to an aspect of the present disclosure, there is provided a waste liquid collecting device which collects a liquid and includes a waste liquid receiving member to receive the liquid to be discharged from nozzles of a liquid ejecting portion, the waste liquid receiving member configured to face a nozzle surface in which the nozzles of the liquid ejecting portion are disposed, and the waste liquid receiving member has dripping waste liquid receiving areas which are provided with through-holes and which receive the liquid to drip down after being discharged from the nozzles and staying on the nozzle surface, and flushing receiving areas which are not provided with the through-holes and which receive the liquid to be jetted from the nozzles.

According to another aspect of the present disclosure, there is provided a liquid ejecting apparatus comprising: a liquid ejecting portion which ejects a liquid from nozzles disposed in a nozzle surface; and a waste liquid collecting device which collects the liquid and includes a waste liquid receiving member to receive the liquid to be discharged from the nozzles, the waste liquid receiving member configured to face the nozzle surface, and the waste liquid receiving member has: dripping waste liquid receiving areas which are provided with through-holes and which receive the liquid to drip down after being discharged from the nozzles and staying on the nozzle surface; and flushing receiving areas which are not provided with the through-holes and which receive the liquid to be jetted from the nozzles.

According to another aspect of the present disclosure, there is provided a maintenance method of a liquid ejecting apparatus which includes: a liquid ejecting portion which ejects a liquid from nozzles disposed in a nozzle surface; and a waste liquid collecting device which collects the liquid and includes a waste liquid receiving member to receive the liquid to be discharged from nozzles, the waste liquid receiving member configured to face the nozzle surface, and the waste liquid receiving member has: dripping waste liquid receiving areas which are provided with through-holes and which receive the liquid to drip down after being discharged from the nozzles and staying on the nozzle surface; and flushing receiving areas which are not provided with the through-holes and which receive the liquid to be jetted from the nozzles. The maintenance method described above comprises: performing a discharge maintenance by discharging the liquid from the nozzles and allowing the liquid staying on the nozzle surface to drip down to the dripping waste liquid receiving areas, and performing a flushing toward the flushing receiving areas by ejecting the liquid from the nozzles.

DESCRIPTION OF EXEMPLARY EMBODIMENTS

First Embodiment

Figure 1:
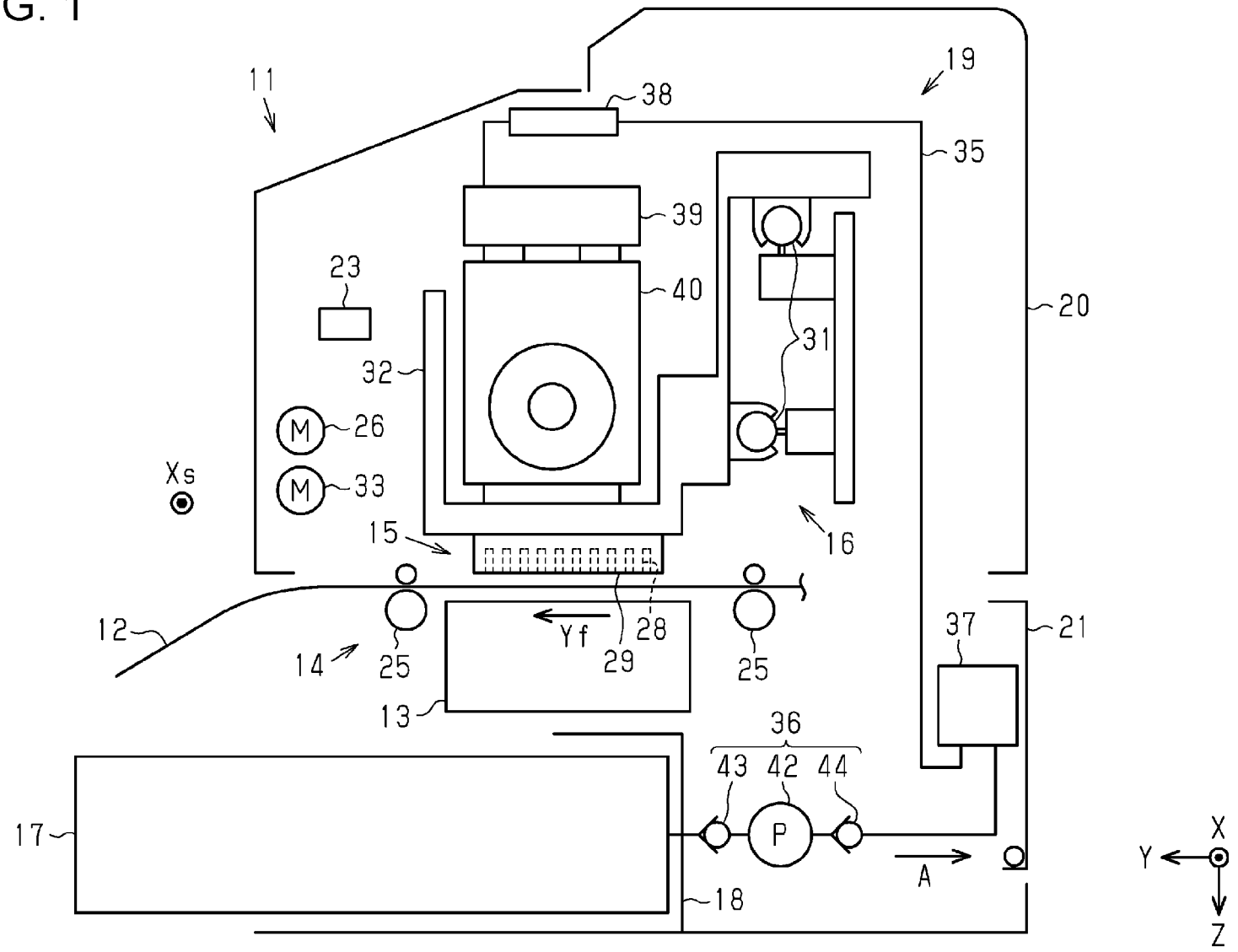
FIG. 1 is a side view schematically showing an internal structure of a first embodiment of a liquid ejecting apparatus.

Hereinafter, a waste liquid collecting device, a liquid ejecting apparatus, a maintenance method of a liquid ejecting apparatus, each according to a first embodiment, will be described with reference to the drawings. The liquid ejecting apparatus is, for example, an ink jet type printer which performs printing by ejecting an ink as one example of a liquid to a medium such as paper.

In the drawings, since a liquid ejecting apparatus 11 is assumed to be placed on a horizontal plane, a gravity direction is shown by a Z axis, and a direction along the horizontal plane is shown by an X axis and a Y axis. The X axis, the Y axis, and the Z axis are orthogonal to each other. In the following description, a direction parallel to the Z axis is also called a vertical direction Z.

As shown in FIG. 1, the liquid ejecting apparatus 11 comprises: a support 13 supporting a medium 12, a transport portion 14 transporting the medium 12, a liquid ejecting portion 15 ejecting a liquid toward the medium 12 to be transported, a liquid ejecting portion transfer mechanism 16 capable of transferring the liquid ejecting portion 15 in a scanning direction Xs. The liquid ejecting apparatus 11 may also comprise a fitting portion 18 to which a liquid supply source 17 receiving a liquid is detachably fitted and a liquid supply portion 19 capable of supplying a liquid to the liquid ejecting portion 15. The liquid ejecting apparatus 11 may also comprise a case 20 formed from a housing or a frame and an openable/closable cover 21 fitted to the case 20.

The liquid ejecting apparatus 11 comprises a control portion 23 controlling the transport portion 14, the liquid ejecting portion 15, the liquid ejecting portion transfer mechanism 16, and the liquid supply portion 19. The control portion 23 is formed, for example, of a CPU, a memory, and the like. Since a program stored in the memory is executed by the CPU, the control portion 23 controls the operation of the liquid ejecting apparatus 11.

In the liquid ejecting apparatus 11, the support 13 extends in the scanning direction Xs which is also a width direction of the medium 12. The scanning direction Xs of this embodiment is a direction parallel to the X axis. The support 13 supports the medium 12 located at a printing position.

The transport portion 14 may include a transport roller pair 25 which sandwiches and transports the medium 12 and a transport motor 26 rotating the transport roller pair 25. A plurality of the transport roller pairs 25 may be provided along a transport path of the medium 12. The transport portion 14 transports the medium 12 along the surface of the support 13 by driving the transport motor 26. A transport direction Yf in which the transport portion 14 transports the medium 12 is a direction along the transport path of the medium 12 and is a direction along a surface of the support 13 with which the medium 12 is in contact. The transport direction Yf of this embodiment is parallel to the Y axis at the printing position.

The liquid ejecting portion 15 has a nozzle surface 29 in which nozzles 28 are disposed. The liquid ejecting portion 15 of this embodiment jets a liquid in the vertical direction Z to the medium 12 located at the printing position and performs printing on the medium 12.

The liquid ejecting portion transfer mechanism 16 includes guide shafts 31 provided so as to extend in the scanning direction Xs, a carriage 32 guided by the guide shafts 31, and a carriage motor 33 which transfers the carriage 32 along the guide shafts 31. The carriage 32 supports the liquid ejecting portion 15 so that the nozzle surface 29 faces the support 13 in the vertical direction Z. The liquid ejecting portion transfer mechanism 16 reciprocally transfers the carriage 32 and the liquid ejecting portion 15 along the guide shafts 31 in the scanning direction Xs and a direction opposite thereto.

The liquid ejecting apparatus 11 may comprise a plurality of the fitting portions 18 and a plurality of the liquid supply portions 19. The liquid supply sources 17 fitted to the respective fitting portions 18 may receive different types of liquids from each other. As the different types of liquids, for example, there may be mentioned inks containing different types of coloring agents, such as pigments and dyes, or having different colors, and moisturizing liquids or cleaning liquids, each of which contains no coloring agent. As the color of the ink, for example, cyan, magenta, yellow, black, white, light magenta, light cyan, light yellow, ash, or orange may be mentioned by way of example.

The liquid ejecting apparatus 11 may perform color printing on the medium 12 by ejecting a plurality of color inks. The liquid ejecting apparatus 11 may also perform monochromatic printing on the medium 12 by ejecting one color ink. The liquid ejecting apparatus 11 may also perform, after underlayer printing is performed by ejecting a white ink, printing thereon using an ink having a color different from white. When the underlayer printing is performed, for example, even if printing is performed on a transparent, a semi-transparent, or a deep color medium 12, printing can be performed with excellent color development.

The liquid supply portion 19 includes a supply path 35 capable of supplying a liquid to be received in the liquid supply source 17 to the liquid ejecting portion 15. The supply path 35 is provided with a supply pump 36, a filter unit 37, a static mixer 38, a liquid storage chamber 39, and a pressure regulator 40 in this order from upstream in a supply direction A.

The supply pump 36 supplies a liquid in the supply direction A. The supply pump 36 includes a diaphragm pump 42, the volume of a pump chamber of which is variable, a suction valve 43 disposed upstream than the diaphragm pump 42, and an ejection valve 44 disposed downstream than the diaphragm pump 42. The suction valve 43 and the ejection valve 44 are each formed of a one-way valve which allows a liquid flow from upstream to downstream and which inhibits a liquid flow from downstream to upstream. The supply pump 36 sucks a liquid from the liquid supply source 17 through the suction valve 43 in association with an increase in volume of the pump chamber of the diaphragm pump 42 and ejects a liquid to the liquid ejecting portion 15 through the ejection valve 44 in association with a decrease in volume of the pump chamber.

The filter unit 37 traps air bubbles and foreign materials in a liquid. The filter unit 37 may be detachably fitted to the supply path 35. When being disposed at a position corresponding to the cover 21, the filter unit 37 can be easily replaced by opening the cover 21.

The static mixer 38 stirs a liquid by changing a flow of a liquid flowing in the supply path 35. The liquid storage chamber 39 stores a liquid to be supplied from the liquid supply source 17. The pressure regulator 40 regulates the pressure of a liquid to be supplied to the liquid ejecting portion 15.

Figure 2:
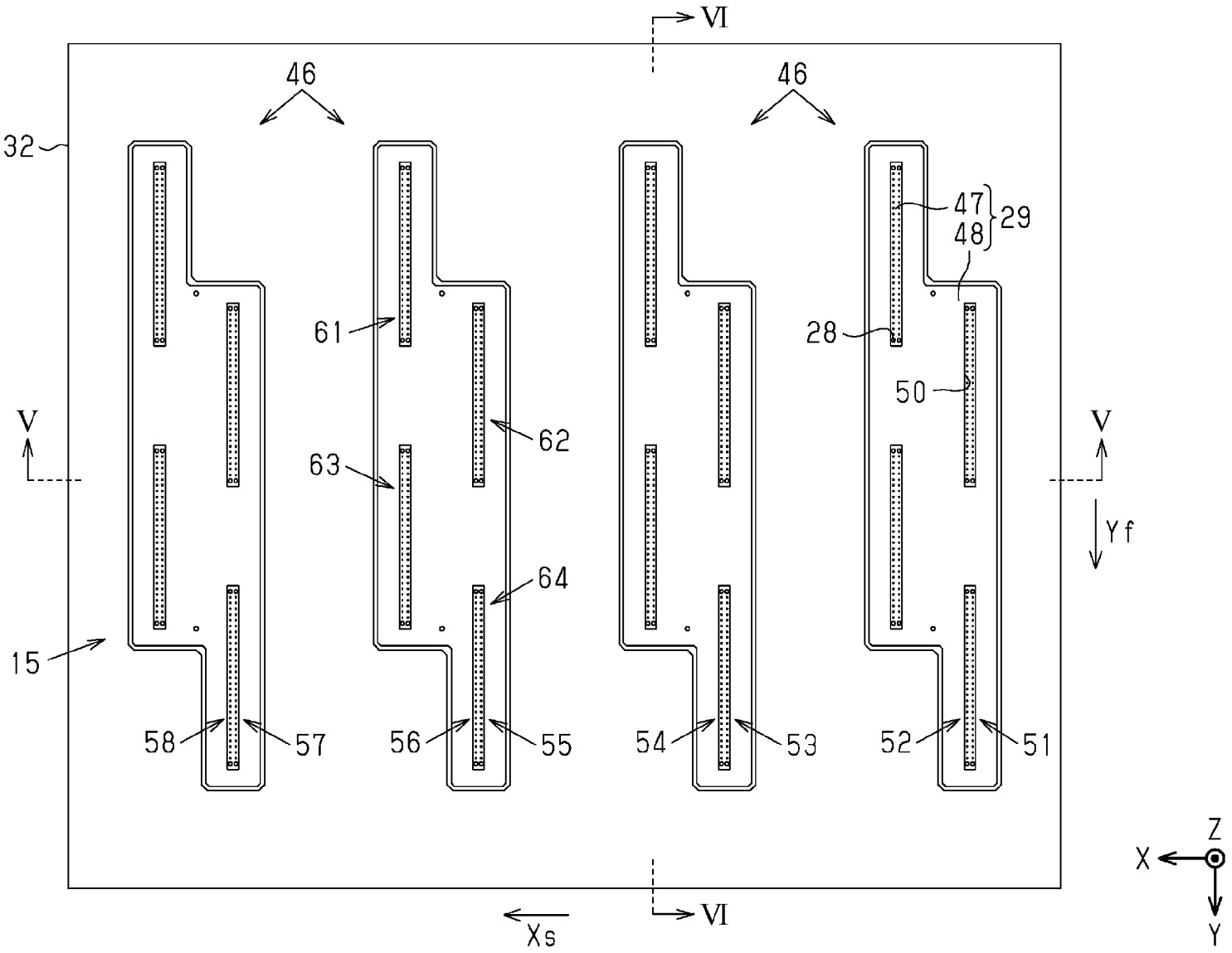
FIG. 2 is a bottom view of a liquid ejecting portion.

As shown in FIG. 2, the liquid ejecting portion 15 may be formed of a plurality of liquid ejecting heads 46 to be fitted to the carriage 32. The liquid ejecting portion 15 of this embodiment includes four liquid ejecting heads 46 disposed in the scanning direction Xs. Since the liquid ejecting heads 46 have the same structure, hereinafter, one liquid ejecting head 46 will be described.

The liquid ejecting head 46 may include a nozzle forming member 47 in which a plurality of nozzles 28 is formed, a cover member 48 partially covering the nozzle forming member 47, and at least one bracket (not shown) to fit the liquid ejecting head 46 to the carriage 32. The cover member 48 is formed, for example, of a metal, such as stainless steel.

In the cover member 48, holes 50 are formed to penetrate the cover member 48 in the vertical direction Z. The cover member 48 covers the nozzle forming member 47 so as to expose the nozzles 28 through the holes 50.

The nozzle surface 29 is formed to include the nozzle forming member 47 and the cover member 48. In particular, the nozzle surface 29 is formed of the nozzle forming member 47 exposed through the holes 50 and the cover member 48.

In the liquid ejecting head 46, many openings of the nozzles 28 which jet a liquid are disposed in one direction with predetermined intervals. The nozzles 28 form a nozzle line. The liquid ejecting portion 15 of this embodiment includes a first nozzle line 51 to an eighth nozzle line 58 disposed in the scanning direction Xs.

Two out of the first nozzle line 51 to the eighth nozzle line 58 are provided in each liquid ejecting head 46. That is, the first nozzle line 51 and the second nozzle line 52 are provided in the same liquid ejecting head 46, and the third nozzle line 53 and the fourth nozzle line 54 are provided in the same liquid ejecting head 46. The fifth nozzle line 55 and the sixth nozzle line 56 are provided in the same liquid ejecting head 46, and the seventh nozzle line 57 and the eighth nozzle line 58 are provided in the same liquid ejecting head 46. The liquid ejecting portion 15 may jet different types of liquids from the respective nozzle lines or may jet different types of liquids from the respective liquid ejecting heads 46.

One nozzle line is formed of a plurality of nozzles 28 disposed in the transport direction Yf. The nozzles 28 disposed in the transport direction Yf may be provided so that nozzle groups are shifted in the scanning direction Xs. In this embodiment, the nozzle line is formed from a first nozzle group 61, a second nozzle group 62, a third nozzle group 63, and a fourth nozzle group 64, each of which is disposed in the transport direction Yf. In the scanning direction Xs, the first nozzle group 61 and the third nozzle group 63 are located at the same position, and the second nozzle group 62 and the fourth nozzle group 64 are located at the same position. In the transport direction Yf, the second nozzle group 62 is partially overlapped with the first nozzle group 61 and the third nozzle group 63, and the third nozzle group 63 is also partially overlapped with the fourth nozzle group 64.

Figure 3:
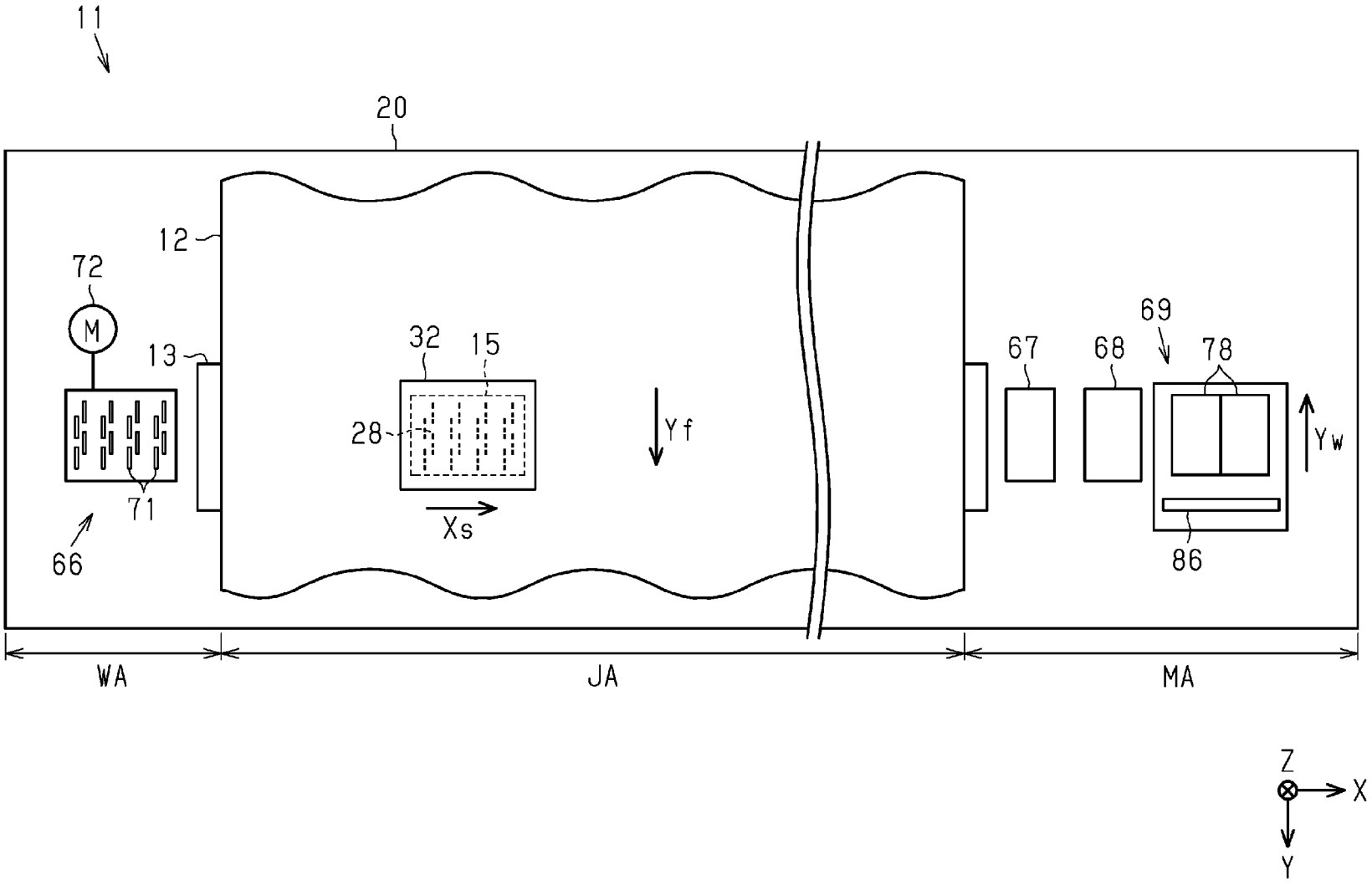
FIG. 3 is a plan view showing an internal structure of the liquid ejecting apparatus.

As shown in FIG. 3, the liquid ejecting apparatus 11 has a ejecting area JA in which the liquid ejecting portion 15 jets a liquid to the medium 12 from the nozzles 28, a maintenance area MA in which the liquid ejecting portion 15 is maintained, and a waiting area WA in which the liquid ejecting portion 15 is waited. The ejecting area JA is an area in which the liquid ejecting portion 15 can jet a liquid to a medium 12 having a largest width. When the liquid ejecting apparatus 11 has a borderless print function, the ejecting area JA is an area slightly larger than the medium 12 having a largest width. The waiting area WA, the ejecting area JA, and the maintenance area MA are disposed in the scanning direction Xs. The ejecting area JA is located between the waiting area WA and the maintenance area MA and is adjacent to the waiting area WA and the maintenance area MA.

The liquid ejecting apparatus 11 comprises a standby cap mechanism 66 disposed in the waiting area WA, and a waste liquid receiving portion 67, a suction mechanism 68, and a waste liquid collecting device 69, each of which is disposed in the maintenance area MA.

This standby cap mechanism 66 may include at least one standby cap 71 and a standby cap motor 72 which transfers the standby cap 71. The standby cap mechanism 66 may also include a moisturizing liquid supply portion (not shown) to supply a moisturizing liquid to the standby cap 71. The standby cap motor 72 reciprocally transfers the standby cap 71 in the Z axis so as to be located at a contact position in contact with the liquid ejecting portion 15 and an evacuation position evacuated from the liquid ejecting portion 15.

The standby cap 71 located at the contact position is in contact with the liquid ejecting portion 15 located in the waiting area WA to surround the openings of the nozzles 28. Accordingly, the nozzles 28 are suppressed from being dried. The standby cap mechanism 66 of this embodiment has a plurality of standby caps 71, and the standby caps 71 each collectively surround two nozzle lines of each nozzle group. The standby cap mechanism 66 may be formed, for example, such that the nozzles 28 of one liquid ejecting head 46 are collectively surrounded with one standby cap 71 or such that all the nozzles 28 are collectively surrounded with one standby cap 71.

Figure 4:
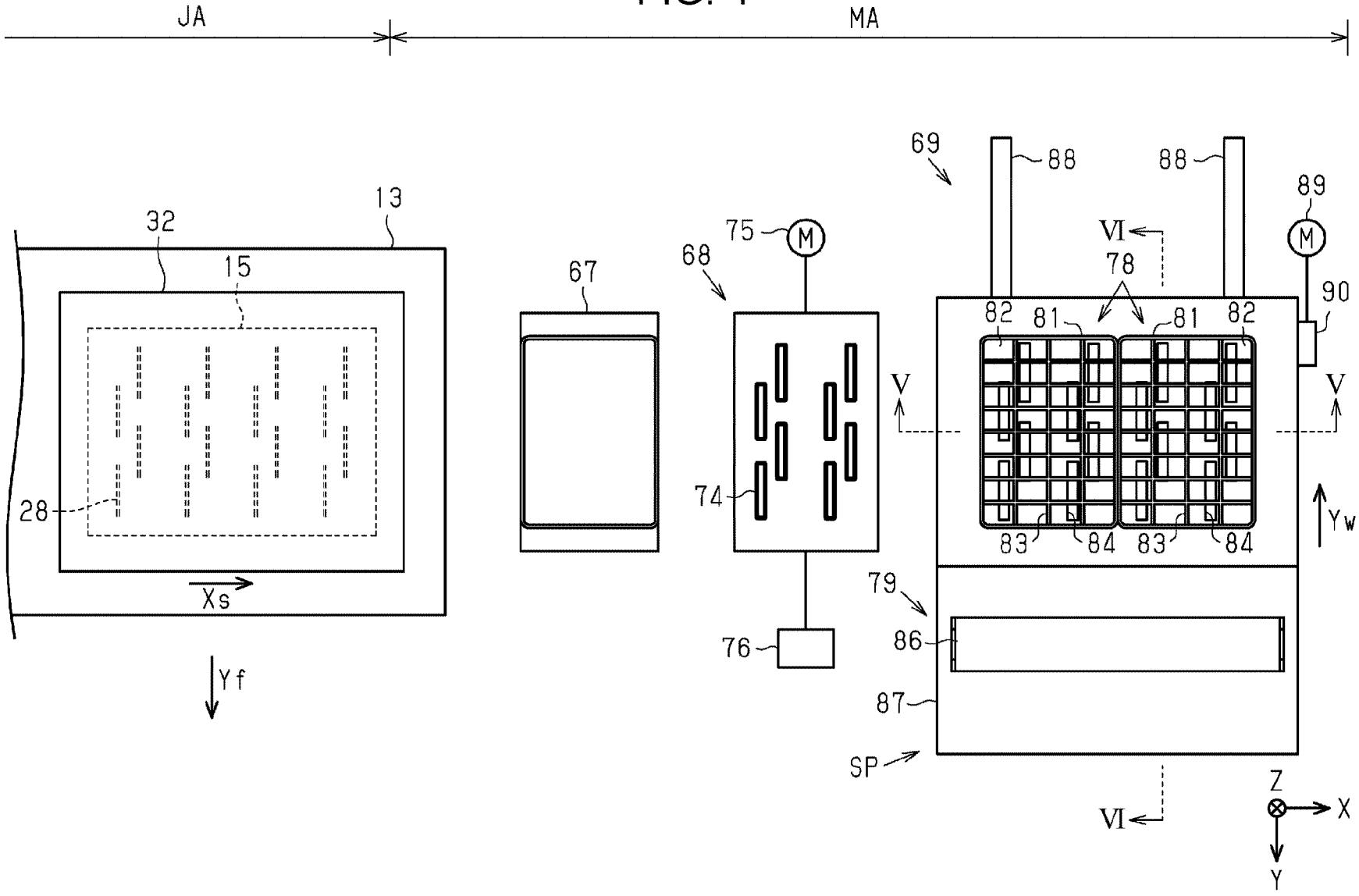
FIG. 4 is a plan view showing a maintenance area.

As shown in FIG. 4, the waste liquid receiving portion 67 is provided at a position adjacent to the support 13 in the scanning direction Xs. The waste liquid receiving portion 67 collects a liquid to be discharged by a flushing during printing. The flushing indicates a maintenance operation to jet a liquid from the nozzles 28 for discharge. While the printing is performed by ejecting a liquid in the ejecting area JA, the liquid ejecting portion 15 performs the flushing in order to prevent or overcome the clogging of the nozzles 28.

The suction mechanism 68 includes suction caps 74, a suction motor 75 to reciprocally transfer the suction caps 74 along the Z axis, and a discharge mechanism 76 to discharge a liquid in the suction caps 74. The suction motor 75 reciprocally transfers the suction caps 74 along the Z axis so as to be located at a suction position in contact with the liquid ejecting portion 15 and a non-suction position apart from the liquid ejecting portion 15.

The suction caps 74 located at the suction positions are in contact with the liquid ejecting portion 15 which stops above the suction mechanism 68 to surround the openings of the nozzles 28. While the suction caps 74 surround the nozzles 28, the suction mechanism 68 drives the discharge mechanism 76 so as to discharge a liquid from the nozzles 28 surrounded by the suction caps 74. The suction mechanism 68 of this embodiment includes eight suction caps 74 which can simultaneously suck the two liquid ejecting heads 46 such that the nozzles 28 of each liquid ejecting head 46 are surrounded by four suction caps 74. That is, one suction cap 74 surrounds two nozzle lines of each nozzle group. The suction mechanism 68 may be formed such that the nozzles 28 of one liquid ejecting head 46 are surround by one suction cap 74 or such that all the nozzles 28 are collectively surrounded by one suction cap 74.

Next, the waste liquid collecting device 69 will be described.

As shown in FIG. 4, the waste liquid collecting device 69 is disposed at a position capable of facing the nozzles 28 of the liquid ejecting portion 15 which is transferred in the scanning direction Xs and collects a liquid to be discharged from the nozzles 28 as a waste liquid. The waste liquid collecting device 69 includes at least one waste liquid collecting portion 78 collecting a liquid to be discharged from the nozzles 28. The waste liquid collecting device 69 may include at least two waste liquid collecting portions 78. The waste liquid collecting device 69 may also include a wiping mechanism 79 to wipe the nozzle surface 29.

The waste liquid collecting portion 78 includes a box body 81 having an opening opened upward in the vertical direction, a waste liquid receiving member 82 covering the opening of the box body 81, and a press member 83 pressing the waste liquid receiving member 82. The waste liquid receiving member 82 faces the nozzle surface 29 and receives a liquid to be discharged from the nozzles 28. The waste liquid receiving member 82 may be formed of an absorber capable of absorbing a liquid.

In the waste liquid receiving member 82, through-holes 84 are provided. The same number of the through-holes 84 as that of the holes 50 provided in the liquid ejecting portion 15 may be provided in the same arrangement as that thereof. The size of the through-hole 84 may be either the same as or larger than the size of the hole 50. When the through-holes 84 as described above are provided, in the case in which the liquid ejecting portion 15 is disposed right above the waste liquid receiving member 82, the through-holes 84 can be located right below all the nozzles 28.

Figure 5:
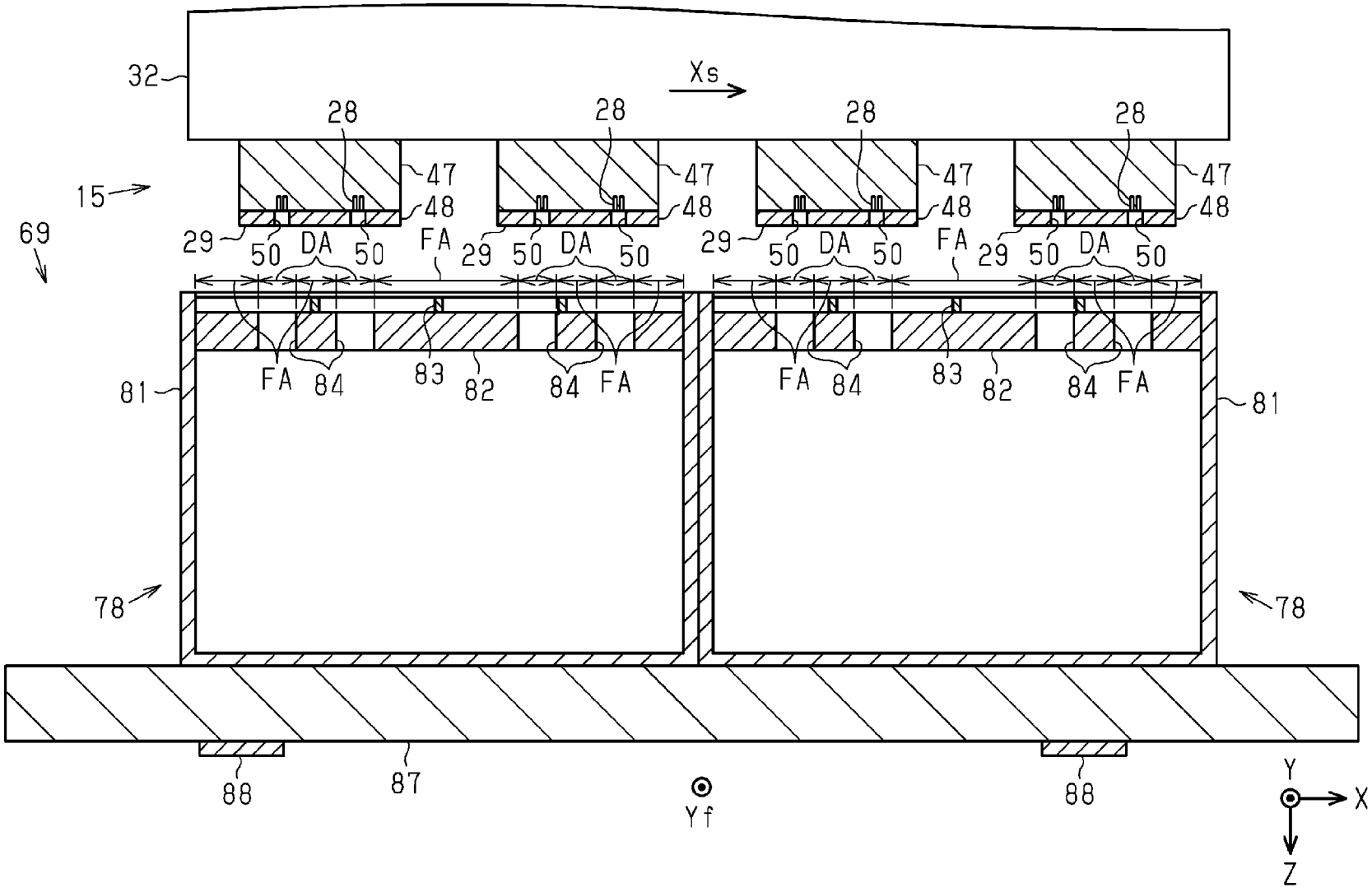
FIG. 5 is a cross-sectional view taken along a line V-V of FIGS. 2 and 4.

As shown in FIG. 5, the top surface of the waste liquid receiving member 82 has dripping waste liquid receiving areas DA and flushing receiving areas FA. The dripping waste liquid receiving areas DA and the flushing receiving areas FA are provided in the scanning direction Xs in which the liquid ejecting portion 15 is transferred. The dripping waste liquid receiving area DA is an area in which the through-hole 84 is provided and which receives a liquid to drip down after being discharged from the nozzles 28 and staying on the nozzle surface 29. The flushing receiving area FA is an area in which the through-hole 84 is not provided and which receives a liquid to be ejected from the nozzles 28.

Figure 6:
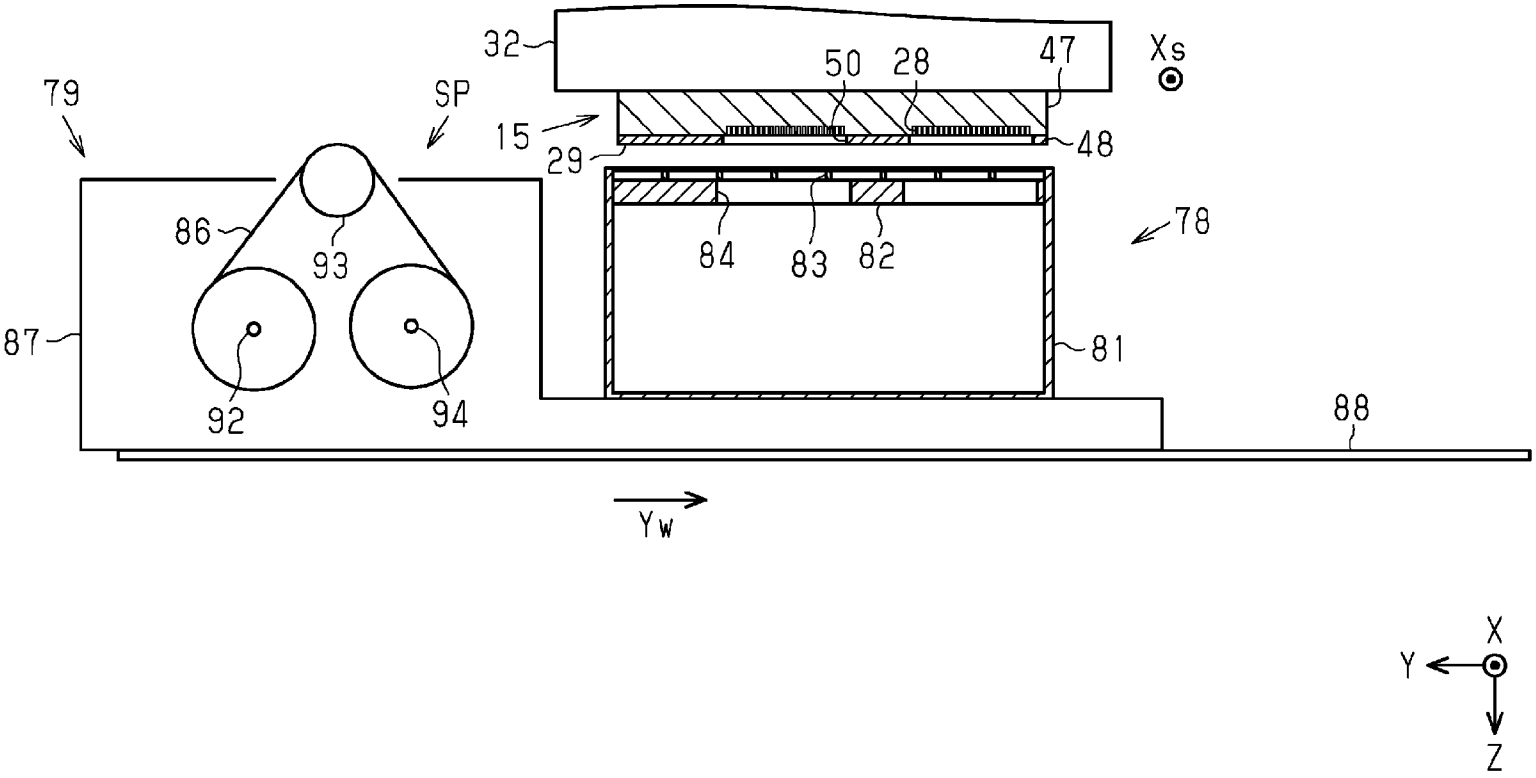
FIG. 6 is a cross-sectional view taken along a line VI-VI of FIGS. 2 and 4.

As shown in FIGS. 4 and 6, the wiping mechanism 79 includes a sheet-shaped wiping member 86 capable of wiping the nozzle surface 29 and a holding portion 87 movable in a wiping direction Yw while holding the wiping member 86. The holding portion 87 may also movably hold the waste liquid collecting portion 78 together with the wiping member 86. The wiping direction Yw of this embodiment is a direction parallel to the Y axis and is a direction opposite to the transport direction Yf at the printing position.

The wiping mechanism 79 includes a pair of rails 88 extending in the wiping direction Yw, a wiping motor 89 to transfer the holding portion 87, and a power transmission mechanism 90 to transmit a power of the wiping motor 89. The power transmission mechanism 90 is formed, for example, of a rack and pinion mechanism. The holding portion 87 is reciprocally transferred on the rails 88 along the Y axis by the power of the wiping motor 89.

The width direction of the wiping member 86 of this embodiment coincides with the scanning direction Xs of the liquid ejecting portion 15. In the scanning direction Xs, the width of the wiping member 86 is larger than the width of the nozzle surface 29 of the liquid ejecting portion 15 and the width of the waste liquid receiving member 82. The waste liquid receiving member 82 may be located inside of the wiping member 86 in the scanning direction Xs, and the dripping waste liquid receiving areas DA may be located inside of the wiping member 86 in the scanning direction Xs. The waste liquid receiving member 82 may be held adjacent to the wiping member 86 in the wiping direction Yw by the holding portion 87.

As shown in FIG. 6, the wiping mechanism 79 includes a feed shaft 92, a press roller 93, and a winding shaft 94. The holding portion 87 rotatably supports the feed shaft 92, the press roller 93, and the winding shaft 94. The holding portion 87 has an opening at an upper side of the press roller 93. The feed shaft 92 feeds the wiping member 86, and the winding shaft 94 winds a used wiping member 86. The press roller 93 presses up the wiping member 86 fed from the feed shaft 92 so as to protrude from the opening of the holding portion 87. The press roller 93 is located upstream in the wiping direction Yw than the waste liquid collecting portion 78.

Figure 7:
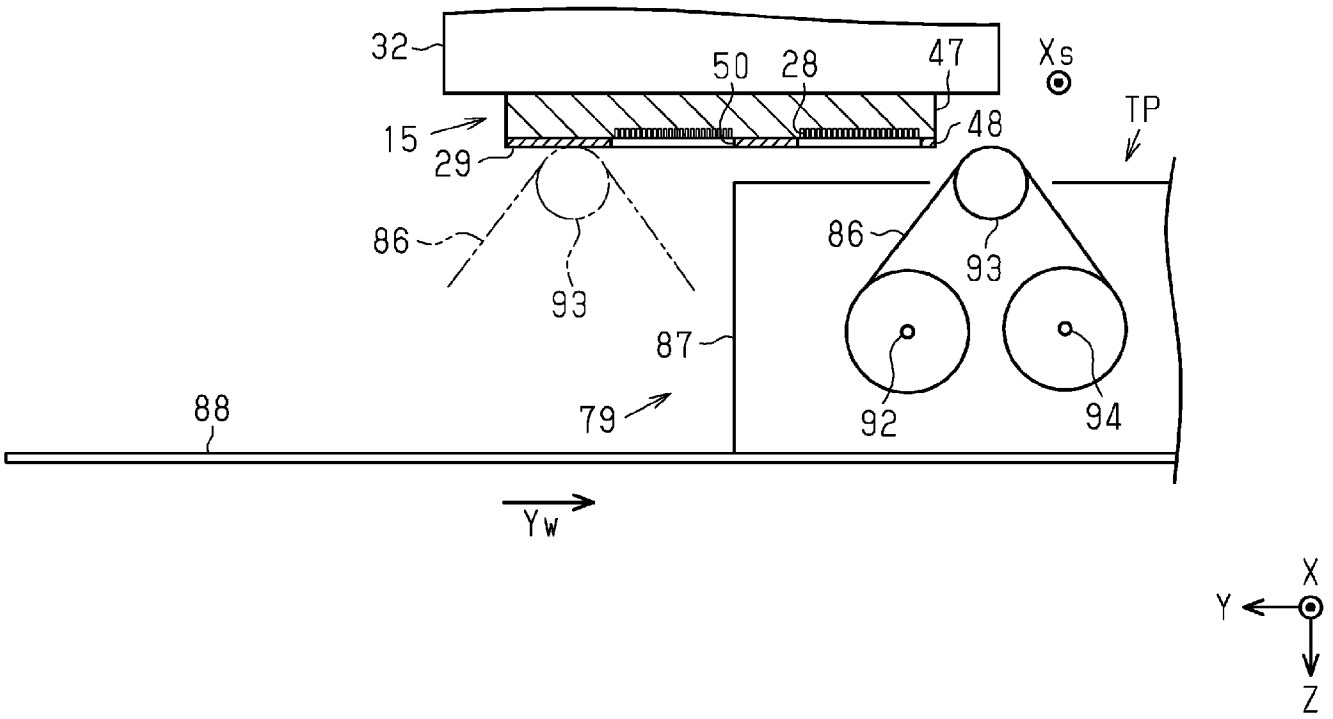
FIG. 7 is a schematic cross-sectional view of a wiping member located at a turning position.

By the normal rotation of the wiping motor 89, the holding portion 87 is transferred from a starting position SP shown in FIG. 6 to a turning position TP shown in FIG. 7 in the wiping direction Yw. While being in contact with the nozzle surface 29, the wiping member 86 is transferred, and in a process in which the holding portion 87 is transferred to the turning position TP from the starting position SP, the wiping member 86 wipes the liquid ejecting portion 15. Subsequently, the holding portion 87 is transferred from the turning position TP to the starting position SP by the reverse rotation of the wiping motor 89. The wiping member 86 may also wipe the liquid ejecting portion 15 in a process in which the holding portion 87 is transferred from the turning position TP to the starting position SP. The wiping is a maintenance operation to wipe the nozzle surface 29 with the wiping member 86.

For example, when the wiping motor 89 is normally rotated, the power transmission mechanism 90 separates the wiping motor 89 from the winding shaft 94, and when the wiping motor 89 is reversely rotated, the power transmission mechanism 90 may couple the wiping motor 89 to the winding shaft 94. That is, the winding shaft 94 may be rotated by a power obtained when the wiping motor 89 is reversely rotated. When the wiping motor 89 is normally rotated, the power transmission mechanism 90 may couple the wiping motor 89 to the winding shaft 94. That is, when the holding portion 87 is transferred from the starting position SP to the turning position TP, the winding shaft 94 may wind the wiping member 86.

The operation of this embodiment will be described.

The control portion 23 performs, as a maintenance of the liquid ejecting portion 15, a discharge maintenance which allows a pressurized liquid to overflow from the nozzles 28, a wiping which wipes the nozzle surface 29, and a flushing which ejects a liquid from the nozzles 28. The discharge maintenance is also called a pressure cleaning.

As shown in FIG. 5, when the discharge maintenance is performed, the control portion 23 transfers the liquid ejecting portion 15 toward a position at which the nozzles 28 face the dripping waste liquid receiving areas DA and stops the liquid ejecting portion 15 at the position. The control portion 23 forcibly opens the pressure regulator 40 and, in addition, also drives the supply pump 36. That is, the control portion 23 controls the liquid supply portion 19 so that a pressurized liquid is supplied to the nozzles 28 and then discharged therefrom. The liquid discharged from the nozzles 28 stays on the nozzle surface 29 so as to wet-spread. As the amount of the liquid staying on the nozzle surface 29 is increased, the liquid drips down from the nozzle surface 29. In this case, the through-holes 84 are located right below the nozzles 28. Hence, in the discharge maintenance, the liquid staying on the nozzle surface 29 is allowed to drip down to the dripping waste liquid receiving areas DA.

As shown in FIG. 7, after the discharge maintenance is performed, while the liquid ejecting portion 15 is stopped, the control portion 23 controls the waste liquid collecting device 69 so that the holding portion 87 is transferred in the wiping direction Yw. That is, the control portion 23 performs the wiping with the wiping member 86, and a liquid which is discharged by the discharge maintenance and which remains on the nozzle surface 29 is wiped out.

After the wiping is performed, the control portion 23 controls the liquid ejecting portion transfer mechanism 16 so as to transfer the liquid ejecting portion 15 in the scanning direction Xs or in a direction opposite thereto. In particular, the control portion 23 transfers the liquid ejecting portion 15 so that when the holding portion 87 is returned to the starting position SP, the nozzles 28 are located at a position facing the flushing receiving areas FA. The control portion 23 of this embodiment transfers the liquid ejecting portion 15 in the direction opposite to the scanning direction Xs by a distance corresponding to the size of the through-hole 84 in the scanning direction Xs. Subsequently, the control portion 23 reversely drives the wiping motor 89 so that the holding portion 87 located at the turning position TP is transferred in the direction opposite to the wiping direction Yw and returned to the starting position SP.

While the holding portion 87 is located at the turning position TP, the liquid ejecting portion 15 is transferred in the scanning direction Xs or the direction opposite thereto. Hence, when the wiping member 86 is returned to the starting position SP from the turning position TP, a portion of the wiping member 86 facing the nozzles 28 is different from a portion thereof facing the nozzles 28 when the wiping member 86 is transferred from the starting position SP to the turning position TP. That is, peripheries of the nozzles 28 at which a liquid is liable to remain are wiped with the portions of the wiping member 86 which are different between in the transfer from the starting position SP to the turning position TP and in the transfer from the turning position TP to the starting position SP.

Figure 8:
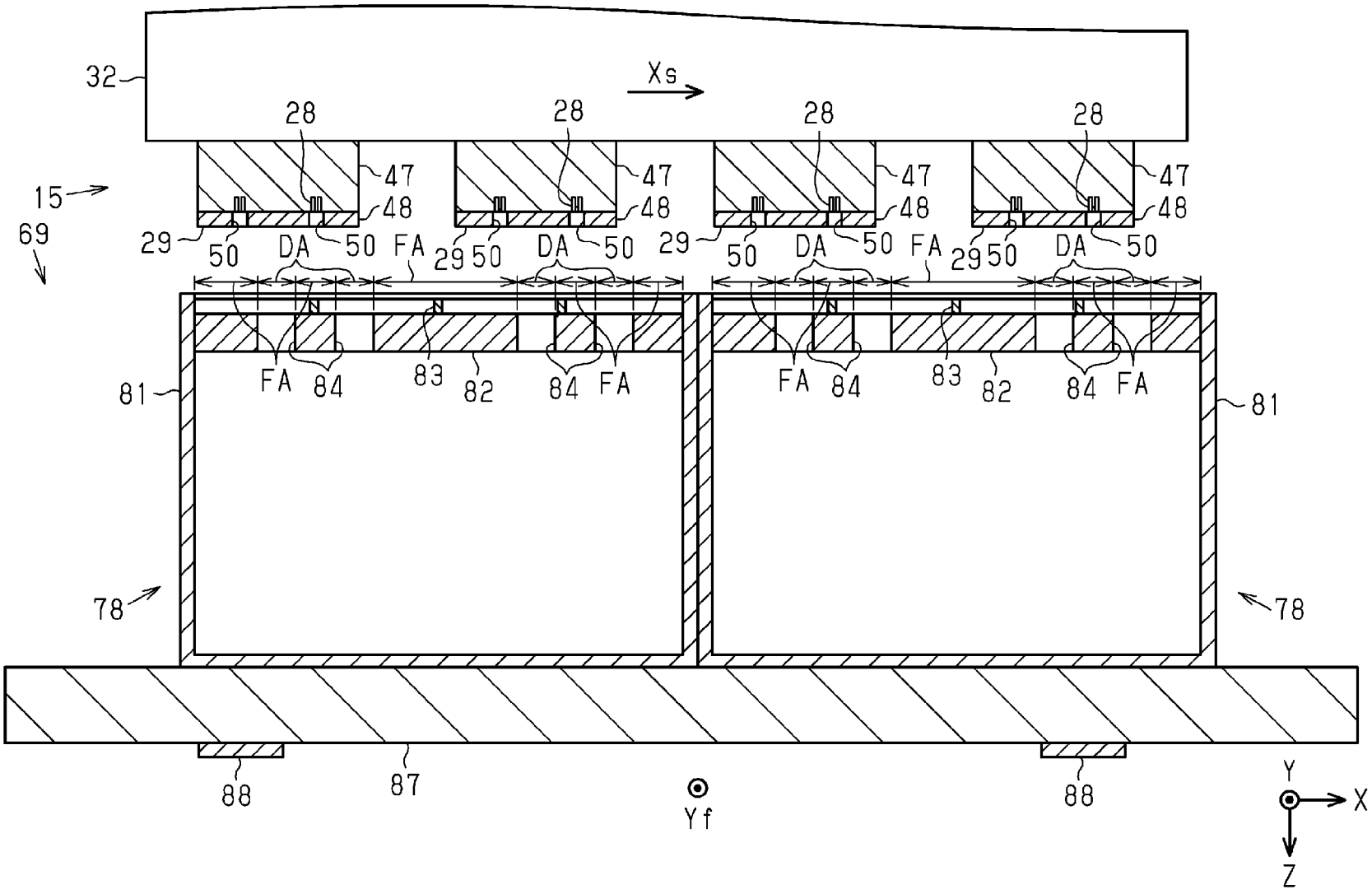
FIG. 8 is a schematic cross-sectional view of a liquid ejecting portion and a waste liquid collecting portion in flushing.

As shown in FIG. 8, when the holding portion 87 is returned to the starting position SP, the nozzles 28 face the flushing receiving areas FA. The control portion 23 performs the flushing toward the flushing receiving areas FA by ejecting a liquid from the nozzles 28. The liquid ejected to the flushing receiving areas FA is absorbed by the waste liquid receiving member 82. When a liquid in an amount larger than that to be held by the waste liquid receiving member 82 is discharged, the liquid drips down from the waste liquid receiving member 82 and is then received in the box body 81.

The effects of this embodiment will be described.

(1) In the dripping waste liquid receiving area DA which receives a liquid to drip down after being discharged from the nozzles 28 and staying on the nozzle surface 29, the through-hole 84 is provided. The liquid received in the dripping waste liquid receiving area DA transfers through the through-hole 84. Hence, the liquid is not likely to stay on the surface of the waste liquid receiving member 82, and a preferable maintenance can be performed on the liquid ejecting portion 15.

(2) In the flushing receiving area FA, the through-hole 84 is not provided. In consideration of this point, the waste liquid receiving member 82 in which the dripping waste liquid receiving areas DA and the flushing receiving areas FA are provided is formed of an absorber. The waste liquid receiving member 82 absorbs a liquid received in the flushing receiving area FA, and hence, a liquid to be ejected from the nozzles 28 is also not likely to stay on the surface of the waste liquid receiving member 82.

(3) When a liquid is allowed to drip down from the nozzle surface 29 after staying thereon, a liquid remains on the nozzle surface 29. When the liquid ejecting portion 15 is transferred while the liquid remains on the nozzle surface 29, the liquid may drip down outside the waste liquid collecting device 69, and the periphery thereof may be contaminated in some cases. In consideration of this point, the waste liquid receiving member 82 is located inside of the wiping member 86 in the scanning direction Xs and is disposed adjacent thereto in the wiping direction Yw. Hence, while the liquid ejecting portion 15 is located at a position at which a liquid is discharged to the dripping waste liquid receiving areas DA, the wiping member 86 is able to wipe the nozzle surface 29 of the liquid ejecting portion 15 when being transferred in the wiping direction Yw. Hence, the contamination of the periphery of the waste liquid collecting device 69 can be reduced.

(4) The dripping waste liquid receiving areas DA and the flushing receiving areas FA are disposed in the direction in which the liquid ejecting portion 15 is transferred. Hence, the waste liquid receiving member 82 can easily allow the dripping waste liquid receiving areas DA and the flushing receiving areas FA to face the nozzles 28 of the liquid ejecting portion 15 which is to be transferred.

(5) When the liquid ejecting apparatus 11 is used in a high temperature environment, a liquid absorbed in the waste liquid receiving member 82 evaporates, and as a result, due to the clogging of the waste liquid receiving member 82, a liquid may be not likely to drip down therefrom in some cases. In the state described above, when a discharge maintenance in which the discharge amount of a liquid is larger than that of the flushing is performed, a liquid to be discharged stays on the waste liquid receiving member 82, and as a result, the waste liquid receiving member 82 and the nozzle surface 29 are coupled to each other with a liquid interposed therebetween. In consideration of this point, since a liquid discharged by the discharge maintenance flows through the through-holes 84 provided in the dripping waste liquid receiving areas DA, a preferable maintenance can be performed on the liquid ejecting portion 15.

Second Embodiment

Next, a waste liquid collecting device, a liquid ejecting apparatus, and a maintenance method of a liquid ejecting apparatus according to a second embodiment will be described with reference to the drawings. In addition, this second embodiment is different from the first embodiment in terms of the structure of the waste liquid receiving member 82. In addition, since the other points are substantially the same as those of the first embodiment, the same structure is designated by the same reference numeral, and duplicated description will be omitted.

Figure 9:
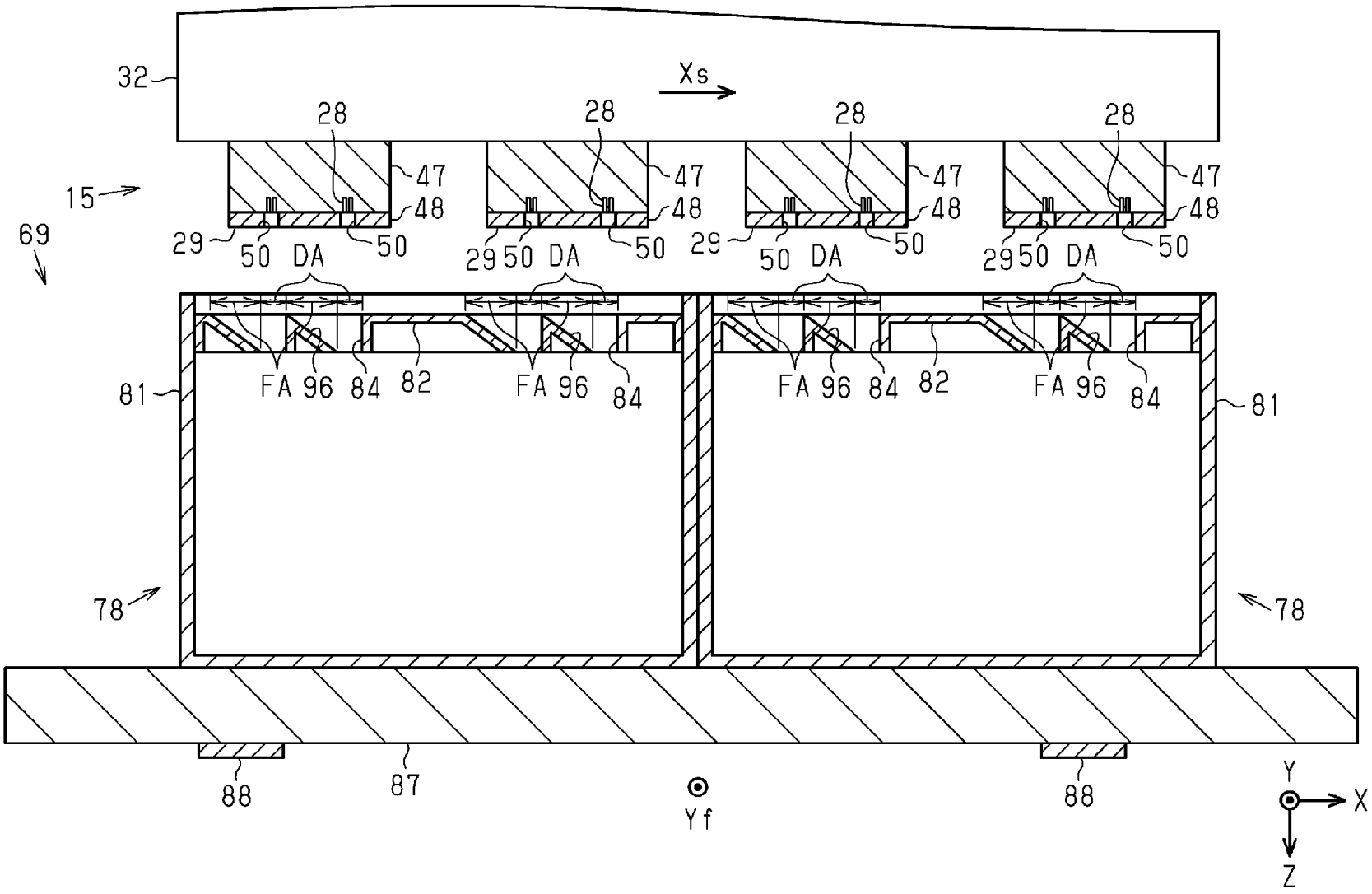
FIG. 9 is a schematic cross-sectional view of a waste liquid collecting portion of a liquid ejecting apparatus of a second embodiment.

As shown in FIG. 9, in the flushing receiving area FA of the waste liquid receiving member 82, an inclined surface 96 inclined to the through-hole 84 is provided. The waste liquid receiving member 82 may be formed of a member absorbing no liquid. When the inclined surface 96 stats to gradually incline from a position closer to the ejecting area JA than the through-hole 84 to a position apart from the ejecting area JA, a liquid and/or a mist repelled when the liquid is received by the inclined surface 96 is not likely to reach the ejecting area JA.

The operation of this embodiment will be described.

As shown in FIG. 9, when the discharge maintenance is performed, the control portion 23 transfers the liquid ejecting portion 15 to a position at which the nozzles 28 face the dripping waste liquid receiving areas DA and then discharges a liquid from the nozzles 28. After staying on the nozzle surface 29, the liquid thus discharged from the nozzles 28 drips down to the dripping waste liquid receiving areas DA.

Figure 10:
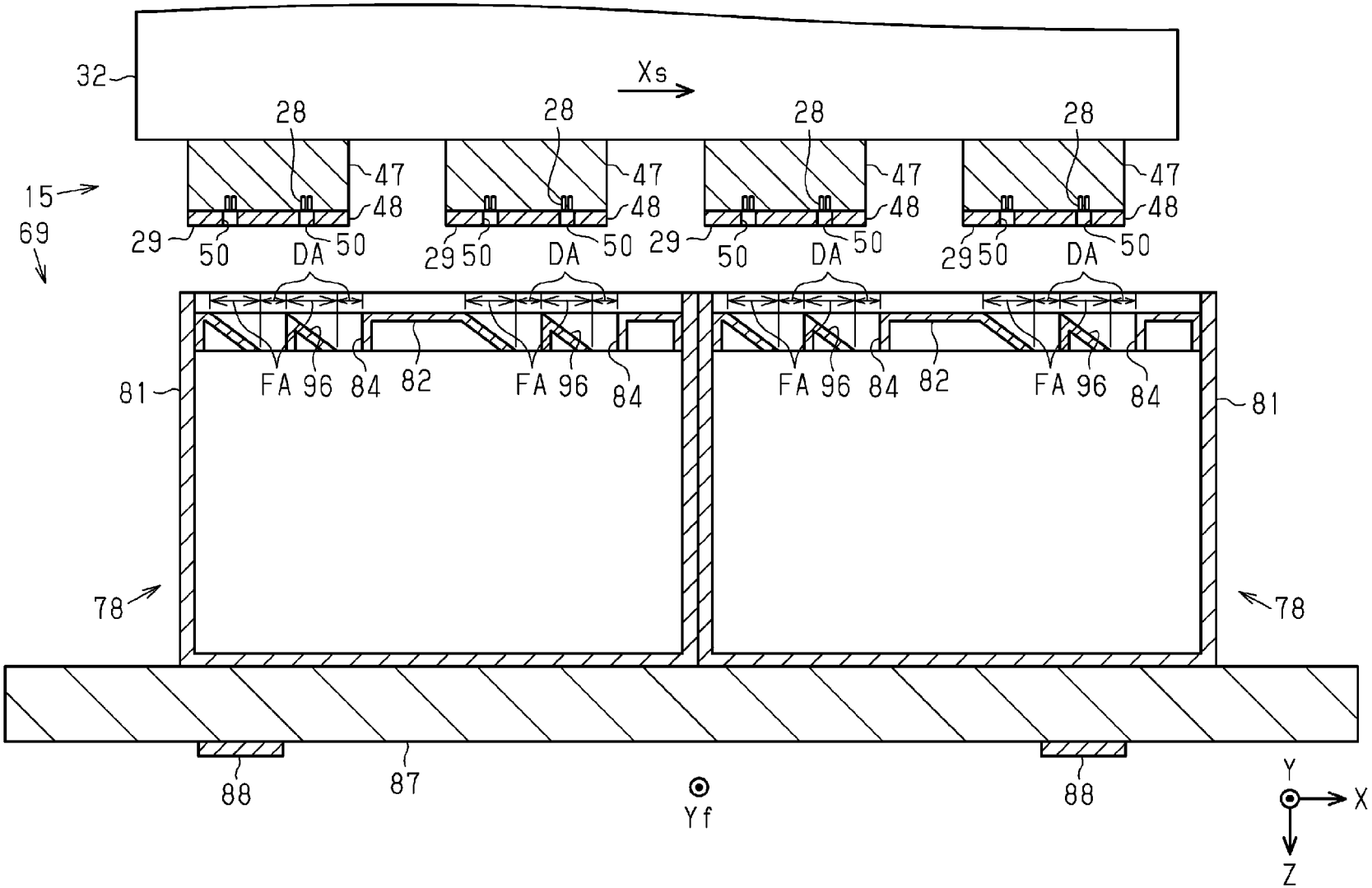
FIG. 10 a schematic cross-sectional view of a liquid ejecting portion and a waste liquid collecting portion in flushing.

As shown in FIG. 10, the control portion 23 drives the liquid ejecting portion transfer mechanism 16 to transfer the liquid ejecting portion 15 to a position at which the nozzles 28 face the flushing receiving areas FA. The control portion 23 allows the liquid ejecting portion 15 to perform the flushing toward the flushing receiving areas FA by ejecting a liquid from the nozzles 28. A liquid received in the flushing receiving areas FA transfers to the through-holes 84 along the inclined surfaces 96 and then drips down in the box body 81 through the through-holes 84. The control portion 23 may perform, as is the case of the first embodiment, the discharge maintenance, the wiping, and the flushing in this order.

The effect of this embodiment will be described.

(6) In the flushing receiving area FA, the inclined surface 96 is provided. Since a liquid received in the flushing receiving area transfers to the through-hole 84 along the inclined surface 96, even if the waste liquid receiving member 82 absorbs no liquid, the amount of a liquid staying in the flushing receiving areas FA can be reduced.

This embodiment may be changed and/or modified as described below. This embodiment and the following modified examples may be used in combination as long as causing no technical conflicts therebetween.

Figure 11:
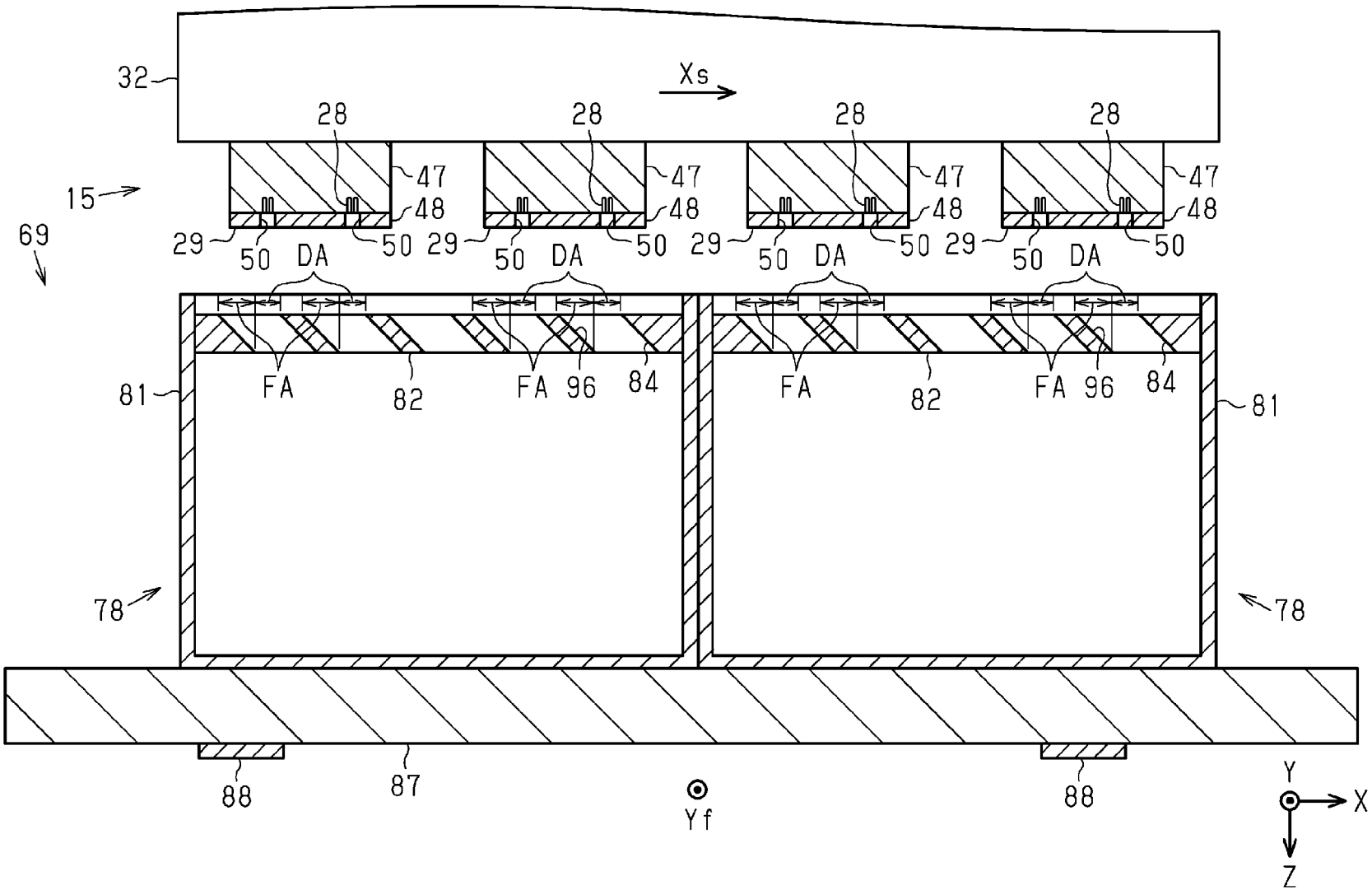
FIG. 11 is a schematic cross-sectional view of a modified example of the waste liquid collecting portion.

As shown in FIG. 11, the through-hole 84 may be formed to have an angle with respect to the vertical direction Z. In this case, a portion penetrating in the vertical direction Z may be regarded as the dripping waste liquid receiving area DA, and a portion forming the inclined surface 96 may be regarded as the flushing receiving area FA. The number of the through-holes 84 disposed in the scanning direction Xs may be set to be larger than the number of the holes 50 in the scanning direction Xs. When the through-holes 84 each formed to have an angle with respect to the vertical direction Z are not allowed to penetrate in the vertical direction Z, in the waste liquid receiving member 82, an area having a long distance from the opening of the nozzle 28 to the surface of the waste liquid receiving member 82 may be regarded as the dripping waste liquid receiving area DA, and an area having a short distance therefrom may be regarded as the flushing receiving area FA.

Figure 12:
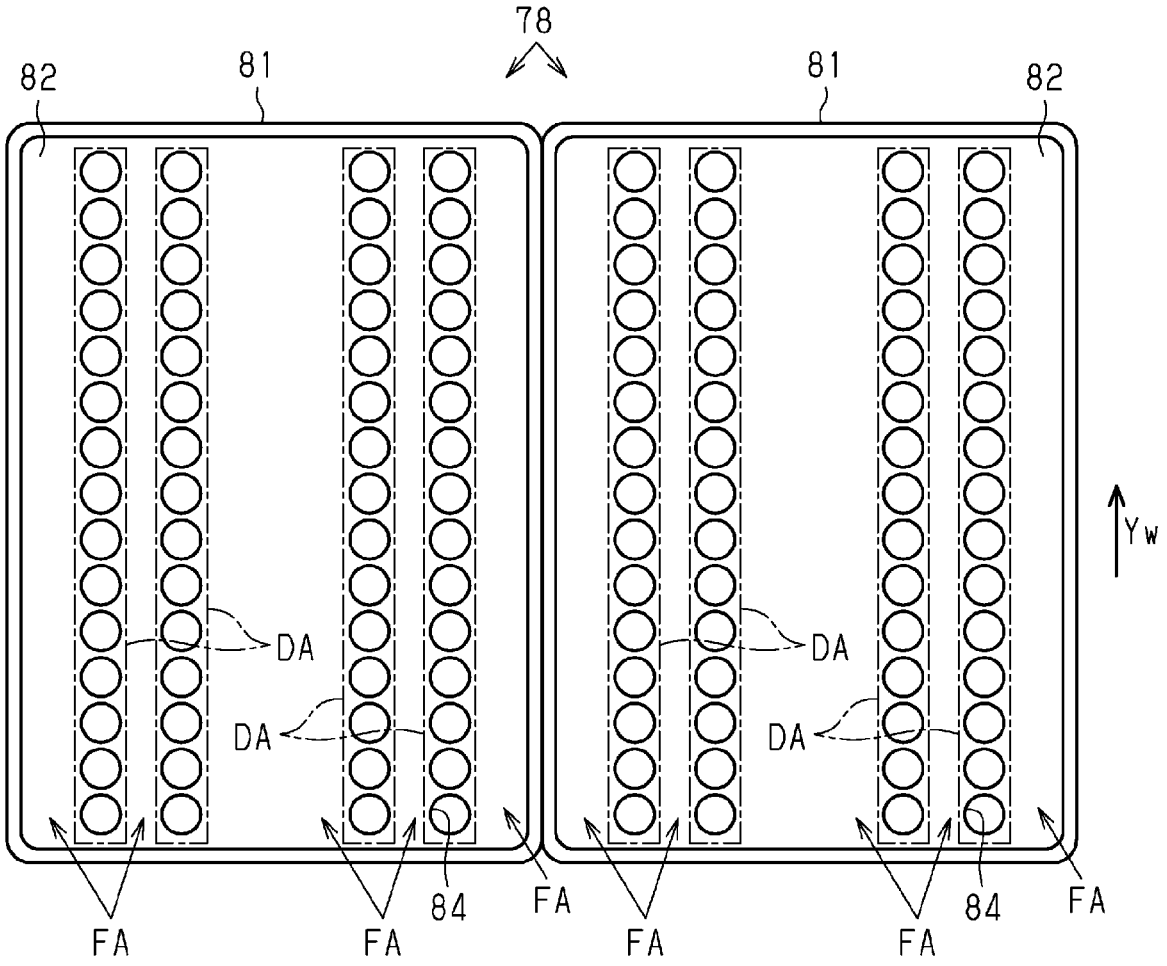
FIG. 12 is a schematic plan view of a modified example of the waste liquid collecting portion.

As shown in FIG. 12, the shape of the through-hole 84 may be arbitrarily changed. For example, round through-holes 84 may be disposed in the wiping direction Yw, and an area in which the through-hole 84 is provided may be regarded as the dripping waste liquid receiving area DA. In the scanning direction Xs, an area adjacent to the dripping waste liquid receiving area DA may be regarded as the flushing receiving area FA.

In the liquid ejecting apparatus 11, the structure of the waste liquid receiving portion 67 may be the same as that of the waste liquid collecting portion 78. That is, the same as the waste liquid collecting portion 78 may be provided at a position at which the waste liquid receiving portion 67 is disposed. In the flushing performed during the printing, the liquid ejecting portion 15 may eject a liquid toward the flushing receiving areas FA of the waste liquid collecting portion 78 provided at a position adjacent to the ejecting area JA.

The waste liquid collecting device 69 may be disposed at a position adjacent to the ejecting area JA. The waste liquid collecting device 69 may collect, as a waste liquid, a liquid discharged in association with the discharge maintenance and the flushing performed thereafter and a liquid discharged in association with the flushing performed during the printing.

The waste liquid collecting device 69 may receives a liquid to be discharged from the first nozzle line 51 to the eighth nozzle line 58 by one waste liquid receiving member 82.

The waste liquid receiving member 82 may be detachably fitted to the box body 81.

The waste liquid receiving member 82 may be formed of an absorber capable of absorbing a liquid and a member absorbing no liquid in combination. For example, the flushing receiving area FA may be formed of an absorber. Since a liquid ejected from the nozzles 28 is received by the absorber, compared to the case in which a liquid is received by the member absorbing no liquid, the generation of mist can be reduced. The dripping waste liquid receiving area DA may be formed of a member absorbing no liquid but having the through-hole 84. For example, compared to an absorber, such as a sponge, since the through-holes 84 can be easily formed in a member, such as a resin plate, absorbing no liquid, an arbitrary number of through-holes 84 can be easily formed to have an arbitrary shape, size, and the like.

The wiping member 86 may be formed of an elastic deformable material, such as rubber.

The wiping member 86 may be provided adjacent to the waste liquid receiving member 82 in the scanning direction Xs. While being in contact with the liquid ejecting portion 15 which is transferred in the scanning direction Xs, the wiping member 86 may wipe the nozzle surface 29. The wiping direction Yw in which the wiping member 86 is transferred may be the same direction as the scanning direction Xs or a direction opposite thereto.

In the waste liquid collecting device 69, the waste liquid receiving member 82 may be transferred to a position at which the dripping waste liquid receiving areas DA face the nozzles 28 or to a position at which the flushing receiving areas FA face the nozzles 28.

The dripping waste liquid receiving areas DA and the flushing receiving areas FA may also be disposed in the wiping direction Yw.

The liquid ejecting apparatus 11 may be a liquid ejecting apparatus which jets or ejects a liquid other than an ink. As the form of a liquid to be ejected from the liquid ejecting apparatus into fine small liquid droplets, a liquid having a particle shape, a tear shape, or a thread shape like a tail may be included. In this embodiment, as the liquid, any material which can be ejected by a liquid ejecting apparatus may be used. For example, the liquid may be a material in a liquid phase and may include a fluid, such as a liquid having a high or a low viscosity, a sol, gel water, an inorganic solvent, an organic solvent, a solution, a liquid resin, a liquid metal, or a metal melt. The liquid is not limited to a liquid as one state of matter and may also include particles of a functional material dissolved, dispersed, or mixed in a solvent, the functional material being formed from a solid compound, such as a pigment or metal particles. As a typical example of the liquid, for example, the inks as described in the above embodiments and liquid crystals may be mentioned. In this case, the ink includes, besides general aqueous inks and oil inks, various types of liquid compositions, such as a gel ink and a hot melt ink. As a particular example of the liquid ejecting apparatus, for example, there may be mentioned an apparatus which ejects a liquid containing a material, such as an electrode material or a coloring agent, in the form of dispersion or solution, the material being used for manufacturing of a liquid crystal display, an electroluminescent display, a surface-emitting display, or a color filter. The liquid ejecting apparatus may also be an apparatus ejecting a bioorganic material to be used for biochip manufacturing, an apparatus to be used as a precision pipette which ejects a liquid as a sample, a printing apparatus, a micro dispenser, or the like. The liquid ejecting apparatus may also be an apparatus ejecting a lubricant oil to a pinpoint of a precision machine, such as a watch or a camera, or an apparatus ejecting a transparent liquid, such as a UV curable resin, to a substrate to form a fine semi-spherical lens or an optical lens to be used for an optical communication element or the like. In addition, the liquid ejecting apparatus may also be an apparatus ejecting an etching liquid, such as an acid or a base, to etch a substrate or the like.

Next, the ink which is one example of the liquid will be described in detail.

An ink to be used for the liquid ejecting apparatus 11 contains a resin as one component and substantially contains no glycerin having a boiling point of 290° C. at an atmospheric pressure. When the ink substantially contains glycerin, a drying property of the ink is significantly degraded. As a result, on various types of media, in particular, on an ink non-absorbent and an ink low-absorbent medium, density irregularity of an image is not only apparent, but fixability of the ink also cannot be obtained. Furthermore, the ink preferably substantially contains no alkyl polyol (other than glycerin mentioned above) having a boiling point of 280° C. or more at an approximately atmospheric pressure.

Incidentally, the "substantially contains no" in this specification indicates that an amount to be added is not sufficiently enough to obtain the purpose of the addition. This indicates that in a quantitative manner, the content of glycerin is with respect to the total mass (100 percent by mass) of the ink, preferably less than 1.0 percent by mass, more preferably less than 0.5 percent by mass, even more preferably less than 0.1 percent by mass, further preferably less than 0.05 percent by mass, and particularly preferably less than 0.01 percent by mass. In addition, the content of glycerin is most preferably less than 0.001 percent by mass.

Next, additives (components) contained or to be contained in the ink will be described.

1. Coloring Agent

The ink may contain a coloring agent. The coloring agent is selected from pigments and dyes.

1-1. Pigment

When a pigment is used as the coloring agent, light resistance of the ink can be improved. As the pigment, either an inorganic pigment or an organic pigment may be used. Although the inorganic pigment is not particularly limited, for example, there may be mentioned carbon black, iron oxide, titanium oxide, or silicon oxide.

Although the organic pigment is not particularly limited, for example, there may be mentioned a quinacridone-based pigment, a quinacridone-quinone-based pigment, a dioxazine-based pigment, a phthalocyanine-based pigment, an anthrapyrimidine-based pigment, an anthanthrone-based pigment, an indanthrone-based pigment, a flavanthrone-based pigment, a perylene-based pigment, a diketopyrrolopyrrole-based pigment, a perinone-based pigment, a quinophthalone-based pigment, an anthraquinone-based pigment, a thioindigo-based pigment, a benzimidazolone-based pigment, an isoindolinone-based pigment, an azomethine-based pigment, or an azo-based pigment. As particular examples of the organic pigment, the following may also be mentioned.

As a pigment to be used for a cyan ink, for example, there may be mentioned C.I. Pigment Blue 1, 2, 3, 15, 15:1, 15:2, 15:3, 15:4, 15:6, 15:34, 16, 18, 22, 60, 65, or 66, or C.I. Vat Blue 4 or 60. Among those mentioned above, either C.I. Pigment Blue 15:3 or 15:4 is preferable.

As a pigment to be used for a magenta ink, for example, there may be mentioned C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, or 264, or C.I. Pigment Violet 19, 23, 32, 33, 36, 38, 43, or 50. Among those mentioned above, one selected from the group consisting of C.I. Pigment Red 122, C.I. Pigment Red 202, and C.I. Pigment Violet 19 is preferable.

As a pigment to be used for a magenta ink, for example, there may be mentioned C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, or 213. Among those mentioned above, one selected from the group consisting of C.I. Pigment Yellow 74, 155, and 213 is preferable.

In addition, as pigments used for inks, such as a green ink and an orange ink, having colors other than those described above, known pigments may be mentioned.

Since being capable of suppressing clogging of the nozzles 28 and having a more preferable ejection stability, the pigment preferably has an average particle diameter of 250 nm or less. In addition, the average particle diameter in this specification is on volume basis. As a measurement method, for example, measurement may be performed using a particle size distribution measurement device based on a laser diffraction scattering method as the measurement principle. As the particle size distribution measurement device, for example, a particle size distribution meter (such as Microtrack UPA, manufactured by Nikkiso Co., Ltd.) using a dynamic light scattering method as the measurement principle may be mentioned.

1-2. Dye

As the coloring agent, a dye may be used. The dye is not particularly limited, and for example, an acidic dye, a direct dye, a reactive dye, or a basic dye may be used. The content of the dye is with respect to the total mass (100 percent by mass) of the ink, preferably 0.4 to 12 percent by mass and more preferably 2 to 5 percent by mass.

2. Resin

The ink contains a resin. Since the ink contains a resin, a resin film is formed on a medium, and as a result, the ink can be sufficiently fixed on the medium, and an effect of primarily improving friction resistance of an image is obtained. Hence, a resin emulsion is preferably formed from a thermoplastic resin. Since advantages are obtained such that clogging of the nozzles 28 is not likely to occur and the friction resistance of the medium is obtained, a heat distortion temperature of the resin is preferably 40° C. or more and more preferably 60° C. or more.

Incidentally, the "heat distortion temperature" in this specification is regarded as a glass transition temperature (Tg) or a minimum film forming temperature (MFT). That is, "the heat distortion temperature is 40° C. or more" indicates either a Tg of 40° C. or more or an MFT of 40° C. or more. In addition, compared to Tg, since MFT is more likely to understand the level of redispersibility, the heat distortion temperature is preferably a temperature represented by MFT. When an ink having a superior redispersibility of the resin is used, since the ink is not tightly adhered, the clogging of the nozzles 28 is not likely to occur.

Although a concrete example of the above thermoplastic resin is not particularly limited, for example, there may be mentioned a (meth)acrylic-based polymer, such as a poly (meth)acrylic acid ester or its copolymer, a polyacrylonitrile or its copolymer, a polycyanoacrylate, a polyacrylamide, or a poly(meth)acrylic acid; an olefin-based polymer, such as a polyethylene, a polypropylene, a polybutene, a polyisobutylene, a polystyrene, a copolymer of each of those mentioned above, a petroleum resin, a coumarone-indene resin, or a terpene resin; a vinyl acetate-based or a vinyl alcohol-based polymer, such as a poly(vinyl acetate) or its copolymer, a poly(vinyl alcohol), a poly(vinyl acetal), or a poly(vinyl ether); a halogen-containing polymer, such as a poly(vinyl chloride) or its a copolymer, a poly(vinylidene chloride), a fluorine resin, or a fluorine rubber; a nitrogen-containing vinyl-based polymer, such as a poly(vinyl carbazole), a poly(vinyl pyrrolidone) or its copolymer, a poly(vinyl pyridine), or a poly(vinyl imidazole); a diene-based polymer, such as a polybutadiene or its copolymer, a polychloroprene, or a polyisobutylene (butyl rubber); or another ring-opening polymerization type resin, condensation polymerization type resin, or natural high molecular weight resin.

The content of the resin is with respect to the total mass (100 percent by mass) of the ink, preferably 1 to 30 percent by mass and more preferably 1 to 5 percent by mass. When the content is in the range described above, the glossiness and the friction resistance of an over-coated image to be formed can be further improved. In addition, as a resin which may be contained in the ink, for example, a resin dispersant, a resin emulsion, or a wax may be mentioned.

2-1. Resin Emulsion

The ink may contain a resin emulsion. When a medium is heated, since the resin emulsion forms a resin film preferably together with a wax (emulsion), the ink is sufficiently fixed on the medium, and as a result, an effect of improving the friction resistance of an image can be obtained. By the effect described above, when an ink containing a resin emulsion is printed on a medium, the ink is particularly improved in terms of friction resistance on an ink non-absorbent or an ink low-absorbent medium.

In addition, a resin emulsion functioning as a binder is contained in the ink in an emulsion state. When the resin functioning as a binder is contained in the ink in an emulsion state, the viscosity of the ink can be easily controlled in an appropriate range in an ink jet recording method, and in addition, the storage stability and the ejection stability of the ink can be improved.

Although the resin emulsion is not particularly limited, for example, there may be mentioned a homopolymer or a copolymer of (meth)acrylic acid, a (meth)acrylate, acrylonitrile, cyano acrylate, acrylamide, an olefin, styrene, vinyl acetate, vinyl chloride, vinyl alcohol, a vinyl ether, vinyl pyrrolidone, vinyl pyridine, vinyl carbazole, vinyl imidazole, or vinylidene chloride; a fluorine resin, or a natural resin. Among those resins, a methacrylic-based resin or a styrene-methacrylic acid copolymer-based resin is preferable, an acrylic-based resin or styrene-acrylic acid copolymer-based resin is more preferable, and a styrene-acrylic acid copolymer-based resin is further preferable. In addition, the above copolymer may be any one of a random copolymer, a block copolymer, an alternate copolymer, and a graft copolymer.

In order to further improve the storage stability and the ejection stability of the ink, the average particle diameter of the resin emulsion is preferably 5 to 400 nm and more preferably 20 to 300 nm. The content of the resin emulsion among the resins is preferably 0.5 to 7 percent by mass with respect to the total mass (100 percent by mass) of the ink. When the content is in the range described above, since a solid component concentration can be decreased low, the ejection stability can be further improved.

2-2. Wax

The ink may also contain a wax. Since the ink contains a wax, the fixability of the ink on an ink non-absorbent absorbent or an ink low-absorbent medium can be further improved. As the wax, in particular, an emulsion type is more preferable. Although the wax described above is not particularly limited, for example, there may be mentioned a polyethylene wax, a paraffin wax, or a polyolefin wax, and among those mentioned above, the following polyethylene wax is preferable. In addition, in this specification, the "wax" indicates a wax in which solid wax particles are dispersed in water using a surfactant which will be described below.

Since the ink contains a polyethylene wax, the friction resistance of the ink can be improved. In order to further improve the storage stability and the ejection stability of the ink, the average particle diameter of the polyethylene wax is preferably 5 to 400 nm and more preferably 50 to 200 nm.

The content (solid component basis) of the polyethylene wax is with respect to the total mass (100 percent by mass) of the ink, preferably 0.1 to 3 percent by mass, more preferably 0.3 to 3 percent by mass, and further preferably 0.3 to 1.5 percent by mass. When the content is in the range described above, even on an ink non-absorbent or an ink low-absorbent medium, the ink can be preferably solidified and fixed, and in addition, the storage stability and the ejection stability of the ink can be further improved.

3. Surfactant

The ink may contain a surfactant. Although the surfactant is not particularly limited, for example, a nonionic surfactant may be mentioned. The nonionic surfactant has a function to uniformly spread an ink on a medium. Accordingly, when printing is performed using an ink containing a nonionic surfactant, a highly precise image having substantially no blurring can be obtained. Although the nonionic surfactant as described above is not particularly limited, for example, there may be mentioned a silicone-based, a polyoxyethylene alkyl ether-based, a polyoxypropylene alkyl ether-based, a polycyclic phenyl ether-based, a sorbitan derivative-based, or a fluorine-based surfactant may be mentioned, and among those mentioned above, a silicone-based surfactant is preferable.

Since the storage stability and the ejection stability of the ink can be further improved, the content of the surfactant is preferably 0.1 to 3 percent by mass with respect to the total mass (100 percent by mass) of the ink.

4. Organic Solvent

The ink may also contain a known volatile water-soluble organic solvent. However, as described above, the ink substantially contains no glycerin (boiling point of 290° C. at atmospheric pressure) which is one type of organic solvent and preferably substantially contains no alkyl polyol (other than glycerin mentioned above) having a boiling point of 280° C. or more at approximately atmospheric pressure.

5. Aprotic Polar Solvent

The ink may also contain an aprotic polar solvent. Since the ink contains an aprotic polar solvent, the above resin particles contained in the ink are dissolved, and as a result, the clogging of the nozzles 28 can be effectively suppressed during printing. In addition, since having a function to dissolve a medium formed from a poly(vinyl chloride) or the like, adhesion of an image can be improved.

Although the aprotic polar solvent is not particularly limited, at least one selected from a pyrrolidone, a lactone, a sulfoxide, an imidazolidinone, a sulfolane, an urea derivative, a dialkyl amide, a cyclic ether, and an amide ether is preferably contained. As a typical example of the pyrrolidone, 2-pyrrolidone, N-methyl-2-pyrrolidone, or N-ethyl-2-pyrrolidone may be mentioned; as a typical example of the lactone, γ-butyrolactone, γ-valerolactone, or ε-caprolactone may be mentioned; and as a typical example of the sulfoxide, dimethyl sulfoxide or tetramethyl sulfoxide may be mentioned.

As a typical example of the imidazolidinone, 1,3-dimethyl-2-imidazolidinone may be mentioned; as a typical example of the sulfolane, sulfolane or dimethyl sulfolane may be mentioned; and as a typical example of the urea derivative, dimethyl urea or 1,1,3,3-tetramethyl urea may be mentioned. As a typical example of the dialkyl amide, dimethyl formamide or dimethyl acetamide may be mentioned; and as a typical example of the cyclic ether, 1,4-dioxane or tetrahydrofuran may be mentioned.

Among those mentioned above, in view of the effects described above, a pyrrolidone, a lactone, a sulfoxide, or an amide ether is particularly preferable, and 2-pyrrolidone is most preferable. The content of the above aprotic polar solvent is with respect to the total mass (100 percent by mass) of the ink, preferably 3 to 30 percent by mass and more preferably 8 to 20 percent by mass.

6. Other Components

Besides the components described above, the ink may further contain a fungicide, an antirust agent, and/or a chelating agent.

Next, components of a surfactant to be mixed in a second liquid will be described.

As the surfactant, for example, there may be used a cationic surfactant, such as an alkylamine salt or a quaternary ammonium salt; an anionic surfactant, such as dialkyl sulfosuccinate salt, an alky naphthalene sulfonate salt, or a fatty acid salt; an amphoteric surfactant, such as alkyl dimethyl amine oxide or an alkyl carboxy betaine; or a nonionic surfactant, such as a polyoxyethylene alkyl ether, a polyoxyethylene alkylallyl ether, an acetylene glycol, or a polyoxyethylene/polyoxypropylene block copolymer. Among those surfactants mentioned above, an anionic surfactant or a nonionic surfactant is preferable.

The content of the surfactant is preferably 0.1 to 5.0 percent by mass with respect to the total mass of the second liquid. Furthermore, in view of a foaming property and a defoaming property after foam generation, the content of the surfactant is preferably 0.5 to 1.5 percent by mass with respect to the total mass of the second liquid. In addition, one type of surfactant or at least two types of surfactants may be used. In addition, the surfactant contained in the second liquid is preferably the same as that contained in the ink (first liquid), and for example, when the surfactant contained in the ink (first liquid) is a nonionic surfactant, although the nonionic surfactant is not particularly limited, a silicone-based, a polyoxyethylene alkyl ether-based, a polyoxypropylene alkyl ether-based, a polycyclic phenyl ether-based, a sorbitan derivative-based, or a fluorine-based surfactant may be mentioned, and among those mentioned above, a silicone-based surfactant is preferable.

In particular, in order to obtain a range of foam height immediately after foaming to five minutes thereafter (foam height immediately after foaming: 50 mm or more, and foam height five minutes after foaming: 5 mm or less) in accordance with Ross-Miles method, as the surfactant, an adduct obtained by addition of 4 to 30 moles of ethylene oxide (EO) to acetylene diol is preferably used, and the content of the adduct is preferably set to 0.1 to 3.0 percent by weight with respect to the total weight of a cleaning liquid. In addition, in order to obtain a preferable range of foam height immediately after foaming to five minutes thereafter (foam height immediately after foaming: 100 mm or less, and foam height five minutes after foaming: 5 mm or less) in accordance with Ross-Miles method, an adduct obtained by addition of 10 to 20 moles of ethylene oxide (EO) to acetylene diol is preferably used, and the content of the adduct is preferably set to 0.5 to 1.5 percent by weight with respect to the total weight of the cleaning liquid. However, when the content of the ethylene oxide adduct of acetylene diol is excessive, the content reaches a critical micelle concentration, and emulsion may be unfavorably formed in some cases.

The surfactant has a function to allow an aqueous ink to easily wet-spread on a recording medium. The surfactant which can be used in the present disclosure is not particularly limited, and for example, there may be used an anionic surfactant, such as a dialkyl sulfosuccinate salt, an alky naphthalene sulfonate salt, or a fatty acid salt; a nonionic surfactant, such as a polyoxyethylene alkyl ether, a polyoxyethylene alkyl allyl ether, an acetylene glycol, or a polyoxyethylene/polyoxypropylene block copolymer; a cationic surfactant, such as an alkylamine salt or a quaternary ammonium salt; a silicone-based surfactant, or a fluorine-based surfactant.

In addition, the surfactant has a function to decompose an aggregate into small pieces and to disperse the small pieces by an interface activation effect between the cleaning liquid (second liquid) and the aggregate. In addition, since the surfactant has a function to decrease the surface tension of the cleaning liquid, the cleaning liquid is likely to intrude between the aggregate and the nozzle surface 29, and the aggregate can be effectively peeled away from the nozzle surface 29.

As the surfactant, any compound having a hydrophilic portion and a hydrophobic portion in the same molecule may be preferably used. As a particular example, compounds represented by the following formulas (I) to (IV) are preferable. That is, a polyoxyethylene alkylphenyl ether-based surfactant represented by the following formula (I), an acetylene glycol-based surfactant represented by the following formula (II), a polyoxyethylene alkyl ether-based surfactant represented by the following formula (III), and a polyoxyethylene/polyoxypropylene alkyl ether-based surfactant represented by the following formula (IV) may be mentioned.

[Chem. 1]

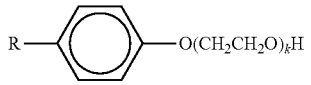

(I)

(R indicates a linear or a branched hydrocarbon chain having 6 to 14 carbon atoms, and k: 5 to 20.)

[Chem. 2]

(II)

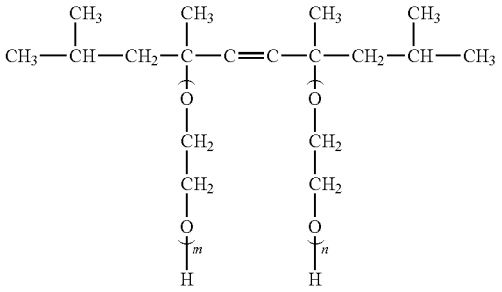

(m, n≤120, and 0<m+n≤40)

[Chem. 3]

$$R—(OCH_2CH_2)nH \quad (III)$$

(R indicates a linear or a branched hydrocarbon chain having 6 to 14 carbon atoms, and n indicates an integer of 5 to 20.)

[Chem. 4]

(IV)

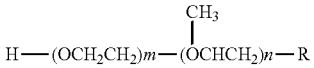

(R indicates a hydrocarbon chain having 6 to 14 carbon atoms, and m and n each indicate an integer of 20 or less.)

Besides the compounds represented by the above formulas (I) to (IV), for example, an alkyl or an aryl ether of a polyvalent alcohol, such as diethylene glycol monophenyl ether, ethylene glycol monophenyl ether, ethylene glycol monoallyl ether, diethylene glycol monobutyl ether, propylene glycol monobutyl ether, or tetraethylene glycol chlorophenyl ether, or a polyoxyethylene/polyoxypropylene block copolymer may be used as a nonionic surfactant; or a fluorine-based surfactant or a lower alcohol, such as ethanol or 2-propsnol, may also be used. In particular, diethylene glycol monobutyl ether is preferable.

Hereinafter, technical concepts and operation effects thereof which are to be understood from the above embodiments and modified examples will be described.

(A) A waste liquid collecting device is a device which collects a liquid and includes a waste liquid receiving member to receive the liquid to be discharged from nozzles of a liquid ejecting portion, the waste liquid receiving member configured to face a nozzle surface in which the nozzles of the liquid ejecting portion are disposed, which includes a waste liquid receiving member to receive a liquid to be discharged from the nozzles, and which collects the liquid, and the waste liquid receiving member has dripping waste liquid receiving areas which are provided with through-holes and which receive the liquid to drip down after being discharged from the nozzles and staying on the nozzle surface and flushing receiving areas which are not provided with the through-holes and which receive the liquid to be ejected from the nozzles.

According to this structure, the dripping waste liquid receiving areas, which receive the liquid to drip down after being discharged from the nozzles and staying on the nozzle surface, are provided with the through-holes. The liquid received in the dripping waste liquid receiving areas transfers through the through-holes. Hence, the liquid is not likely to stay on the surface of the waste liquid receiving member, and hence, a preferable maintenance can be performed on the liquid ejecting portion.

(B) In the waste liquid collecting device, the waste liquid receiving member may be formed of an absorber capable of absorbing the liquid.

In the flushing receiving areas, the through-holes are not provided. In consideration of this point, according to this structure, the waste liquid receiving member in which the dripping waste liquid receiving areas and the flushing receiving areas are provided is formed of an absorber. Since the waste liquid receiving member absorbs the liquid received in the flushing receiving areas, the liquid ejected from the nozzles is also not allowed to easily stay on the surface of the waste liquid receiving member.

(C) In the waste liquid collecting device, the waste liquid receiving member may be formed of a member not absorbing the liquid, and in the flushing receiving areas, inclined surfaces may be provided so that the liquid received in the flushing receiving areas transfers toward the through-holes.

According to this structure, in the flushing receiving areas, the inclined surfaces are provided. Since the liquid received in the flushing receiving areas transfers toward the through-holes along the inclined surfaces, even if the waste liquid receiving member absorbs no liquid, the amount of a liquid staying in the flushing receiving areas can be reduced.

(D) The waste liquid collecting device further includes a wiping member capable of wiping the nozzle surface and a holding portion movable in a wiping direction while holding the wiping member, and the waste liquid receiving member may be held adjacent to the wiping member in the wiping direction by the holding portion so that the dripping waste liquid receiving areas are located inside of the wiping member in a width direction thereof.

When the liquid is allowed to drip down after staying on the nozzle surface, the liquid remains on the nozzle surface. When the liquid ejecting portion is transferred while the liquid remains on the nozzle surface, the liquid may drip down outside the waste liquid collecting device, and the periphery thereof may be contaminated in some cases. However, according to the structure described above, the waste liquid receiving member is located inside of the wiping member in the width direction and is adjacent thereto in the wiping direction. Hence, while the liquid ejecting portion is disposed at a position at which the liquid is discharged to the dripping waste liquid receiving areas, the wiping member can wipe the nozzle surface of the liquid ejecting portion when being transferred in the wiping direction. Hence, the periphery of the waste liquid collecting device can be suppressed from being contaminated.

(E) In the waste liquid collecting device, the dripping waste liquid receiving areas and the flushing receiving areas may be provided in a direction in which the liquid ejecting portion is transferred.

According to this structure, the dripping waste liquid receiving areas and the flushing receiving areas are disposed in the direction in which the liquid ejecting portion is transferred. Hence, the waste liquid receiving member enables the dripping waste liquid receiving areas and the flushing receiving areas to easily face the nozzles of the liquid ejecting portion to be transferred.

(F) A liquid ejecting apparatus comprises a liquid ejecting portion which ejects a liquid from nozzles disposed in a nozzle surface and a waste liquid collecting device which collects the liquid and includes a waste liquid receiving member to receive the liquid to be discharged from the nozzles, the waste liquid receiving member configured to face the nozzle surface, and in the waste liquid receiving member, dripping waste liquid receiving areas which are provided with through-holes and which receive the liquid to drip down after being discharged from the nozzles and staying on the nozzle surface and flushing receiving areas which are not provided with the through-holes and which receive the liquid to be ejected from the nozzles are provided. According to this structure, an effect similar to that of the waste liquid collecting device described above can be obtained.

(G) The liquid ejecting apparatus further comprises a liquid supply portion capable of supplying the liquid to the liquid ejecting portion, a liquid ejecting portion transfer mechanism capable of transferring the liquid ejecting portion in a scanning direction in which a ejecting area in which the liquid is ejected to a medium from the nozzles and a maintenance area in which the waste liquid collecting device is disposed are provided, and a control portion controlling the liquid ejecting portion, the liquid supply portion, and the liquid ejecting portion transfer mechanism; the dripping waste liquid receiving areas and the flushing receiving areas are provided in the scanning direction; and the control portion may transfer the liquid ejecting portion to a position at which the nozzles face the dripping waste liquid receiving areas, perform a discharge maintenance by discharging the liquid from the nozzles, and allow the liquid staying on the nozzle surface to drip down to the dripping waste liquid receiving areas, and may transfer the liquid ejecting portion to a position at which the nozzles face the flushing receiving areas and perform a flushing toward the flushing receiving areas by ejecting the liquid from the nozzles. According to this structure, an effect similar to that of the waste liquid collecting device can be obtained.

(H) In the liquid ejecting apparatus, the waste liquid collecting device further includes a wiping member capable of wiping the nozzle surface and a holding portion movable in a wiping direction while holding the wiping member; the waste liquid receiving member is held adjacent to the wiping member in the wiping direction by the holding portion so that the dripping waste liquid receiving areas are located inside of the wiping member in a width direction thereof; and after the discharge maintenance is performed, the control portion may transfer the holding portion by controlling the waste liquid collecting device and perform a wiping using the wiping member, and may transfer the liquid ejecting portion to a position at which the nozzles face the flushing receiving areas and perform the flushing toward the flushing receiving areas. According to this structure, an effect similar to that of the waste liquid collecting device can be obtained.

(I) A maintenance method of a liquid ejecting apparatus is a maintenance method of a liquid ejecting apparatus which includes a liquid ejecting portion ejecting a liquid from nozzles disposed in a nozzle surface and a waste liquid collecting device which collects the liquid and includes a waste liquid receiving member to receive the liquid to be discharged from nozzles, the waste liquid receiving member configured to face the nozzle surface, the waste liquid receiving member having dripping waste liquid receiving areas which are provided with through-holes and which receive the liquid to drip down after being discharged from the nozzles and staying on the nozzle surface and flushing receiving areas which are not provided with the through-holes and which receive the liquid to be ejected from the nozzles. The maintenance method described above comprises a step of performing a discharge maintenance by discharging the liquid from the nozzles, a step of allowing the liquid staying on the nozzle surface to drip down to the dripping waste liquid receiving areas, and a step of performing a flushing toward the flushing receiving areas by ejecting the liquid from the nozzles. According to this method, an effect similar to that of the above waste liquid collecting device can be obtained.

(J) In the maintenance method of a liquid ejecting apparatus, the waste liquid collecting device further includes a wiping member capable of wiping the nozzle surface and a holding portion movable in a wiping direction while holding the wiping member; the waste liquid receiving member is held adjacent to the wiping member in the wiping direction by the holding portion so that the dripping waste liquid receiving areas are located inside of the wiping member in a width direction thereof; and after the discharge maintenance is performed, the holding portion may be transferred so as to perform a wiping using the wiping member. According to this method, an effect similar to that of the above waste liquid collecting device can be obtained.

What is claimed is:

1. A waste liquid collecting device which collects a liquid and includes a waste liquid receiving member to receive the liquid to be discharged from nozzles of a liquid ejecting portion, the waste liquid receiving member configured to face a nozzle surface in which the nozzles of the liquid ejecting portion are disposed, wherein the waste liquid receiving member has dripping waste liquid receiving areas which are provided with through-holes and flushing receiving areas which are not provided with the through-holes, wherein during a discharge process, the nozzles are moved to a position to face the through-holes and a discharging of liquid from the nozzles occurs, some of the discharged liquid being wet-spread on the nozzle surface during the discharging and then dripping down to be received by the dripping waste liquid receiving areas, and wherein during a flushing process, the nozzles are moved to a position to face the flushing areas and an ejecting of liquid from the nozzles occurs, which is received by the flushing areas.

2. The waste liquid collecting device according to claim 1, wherein the waste liquid receiving member is formed of an absorber configured to absorb the liquid.

3. The waste liquid collecting device according to claim 1, wherein the waste liquid receiving member is formed of a member not absorbing the liquid, and the flushing receiving areas are provided with inclined surfaces inclined so that the liquid received in the flushing receiving areas transfers toward the through-holes.

4. The waste liquid collecting device according to claim 1, further including:

a wiping member configured to wipe the nozzle surface; and a holding portion configured to be transferred in a wiping direction while holding the wiping member, wherein the waste liquid receiving member is held adjacent to the wiping member in the wiping direction by the holding portion so that the dripping waste liquid receiving areas are located inside of the wiping member in a width direction thereof.

5. The waste liquid collecting device according to claim 4, wherein the dripping waste liquid receiving areas and the flushing receiving areas are provided in a direction in which the liquid ejecting portion is transferred.

6. A liquid ejecting apparatus comprising:

a liquid ejecting portion which ejects a liquid from nozzles disposed in a nozzle surface; and a waste liquid collecting device which collects the liquid and includes a waste liquid receiving member to receive the liquid to be discharged from the nozzles, the waste liquid receiving member configured to face the nozzle surface, wherein the waste liquid receiving member has dripping waste liquid receiving areas which are provided with through-holes and flushing receiving areas which are not provided with the through-holes, wherein during a discharge process, the nozzles are moved to a position to face the through-holes and a discharging of liquid from the nozzles occurs, some of the discharged liquid being wet-spread on the nozzle surface during the discharging and then dripping down to be received by the dripping waste liquid receiving areas, and wherein during a flushing process, the nozzles are moved to a position to face the flushing areas and an ejecting of liquid from the nozzles occurs, which is received by the flushing areas.

7. The liquid ejecting apparatus according to claim 6, further comprising:

a liquid supply portion configured to supply the liquid to the liquid ejecting portion;

a liquid ejecting portion transfer mechanism configured to transfer the liquid ejecting portion in a scanning direction in which an ejecting area in which the liquid is ejected to a medium from the nozzles and a maintenance area in which the waste liquid collecting device is disposed are provided; and a control portion controlling the liquid ejecting portion, the liquid supply portion, and the liquid ejecting portion transfer mechanism, wherein the dripping waste liquid receiving areas and the flushing receiving areas are provided in the scanning direction.

8. The liquid ejecting apparatus according to claim 7, wherein the waste liquid collecting device further includes:

a wiping member configured to wipe the nozzle surface; and a holding portion configured to be transferred in a wiping direction while holding the wiping member, wherein the waste liquid receiving member is held adjacent to the wiping member in the wiping direction by the holding portion so that the dripping waste liquid receiving areas are located inside of the wiping member in a width direction thereof, and after the discharge process is performed, the control portion transfers the holding portion by controlling the waste liquid collecting device, and performs a wiping using the wiping member, and transfers the liquid ejecting portion to the position at which the nozzles face the flushing receiving areas, and performs the flushing process toward the flushing receiving areas.

9. A maintenance method of a liquid ejecting apparatus which includes:

a liquid ejecting portion which ejects a liquid from nozzles disposed in a nozzle surface; and a waste liquid collecting device which collects the liquid and includes a waste liquid receiving member to receive the liquid to be discharged from nozzles, the waste liquid receiving member configured to face the nozzle surface, the waste liquid receiving member having:

dripping waste liquid receiving areas which are provided with through-holes and which receive the liquid to drip down after being discharged from the nozzles and staying on the nozzle surface; and flushing receiving areas which are not provided with the through-holes and which receive the liquid to be ejected from the nozzles, the maintenance method comprising:

performing a discharge maintenance by discharging the liquid from the nozzles, wherein during a discharging process of the discharge maintenance, the nozzles are moved to face the through-holes and a discharging of liquid from the nozzles occurs, some of the discharged liquid being wet-spread on the nozzle surface during the discharging and then dripping down to be received by the dripping waste liquid receiving areas, and wherein during a flushing process of the discharge maintenance, the nozzles are moved to face the flushing areas and an ejecting of liquid from the nozzles occurs, which is received by the flushing areas.

10. The maintenance method of a liquid ejecting apparatus, according to claim 9, wherein the waste liquid collecting device further includes:

a wiping member configured to wipe the nozzle surface; and a holding portion configured to be transferred in a wiping direction while holding the wiping member, wherein the waste liquid receiving member is held adjacent to the wiping member in the wiping direction by the holding portion so that the dripping waste liquid receiving areas are located inside of the wiping member in a width direction thereof, and after the discharge maintenance is performed, the holding portion is transferred to perform a wiping using the wiping member.

* * * * *